US011011012B2

(12) United States Patent
Feng et al.

(10) Patent No.: US 11,011,012 B2
(45) Date of Patent: May 18, 2021

(54) TOKEN REPOSITORY APPARATUS WITH ATTRIBUTE CAPTURE AND METHODS THEREFOR

(71) Applicant: Empire Technological Group Limited, Las Vegas, NV (US)

(72) Inventors: Linyi Frank Feng, Las Vegas, NV (US); Daryn Kiely, Henderson, NV (US); Randy Graham, Las Vegas, NV (US)

(73) Assignee: Empire Technological Group Limited, Las Vegas, NV (US)

( * ) Notice: Subject to any disclaimer, the term of this patent is extended or adjusted under 35 U.S.C. 154(b) by 0 days.

(21) Appl. No.: 16/200,636

(22) Filed: Nov. 26, 2018

(65) Prior Publication Data

US 2019/0318568 A1 Oct. 17, 2019

Related U.S. Application Data

(60) Provisional application No. 62/658,551, filed on Apr. 16, 2018.

(51) Int. Cl.
*G07F 17/32* (2006.01)

(52) U.S. Cl.
CPC ..... *G07F 17/322* (2013.01); *G07F 17/3211* (2013.01); *G07F 17/3241* (2013.01)

(58) Field of Classification Search
None
See application file for complete search history.

(56) References Cited

U.S. PATENT DOCUMENTS

| | | | | |
|---|---|---|---|---|
| 4,814,589 | A | 3/1989 | Storch | |
| 5,510,081 | A | 4/1996 | Edwards et al. | |
| 5,735,742 | A | 4/1998 | French | |
| D424,068 | S | 5/2000 | Takemasa | |
| 6,332,099 | B1 * | 12/2001 | Heidel | G07F 17/32 700/231 |
| 6,425,817 | B1 | 7/2002 | Momemy | |
| 6,464,584 | B2 | 10/2002 | Oliver | |
| 6,530,836 | B2 | 3/2003 | Soltys et al. | |

(Continued)

FOREIGN PATENT DOCUMENTS

WO WO 2017/203142 A1 11/2017

OTHER PUBLICATIONS

Notice of Allowance for U.S. Appl. No. 29/600,225, dated May 15, 2018.

(Continued)

*Primary Examiner* — Omkar A Deodhar

(57) ABSTRACT

A token repository apparatus that facilitates management of tokens is disclosed. The token repository apparatus can receive tokens, capture images and/or other metadata pertaining to the tokens, and retain the tokens in a repository. For example, the tokens can be gaming tokens, and the token repository apparatus can be coupled to a multi-player gaming apparatus (e.g., gaming table) supporting wager-based games. Advantageously, gaming tokens, such as pertaining to table commissions or tips, can be securely and reliably deposited. The imaging and/or metadata pertaining to the tokens can be used to validate the tokens being deposited. The token repository apparatus can also facilitate recording of values of various gaming tokens being deposited.

21 Claims, 12 Drawing Sheets

(56) References Cited

U.S. PATENT DOCUMENTS

| | | | | |
|---|---|---|---|---|
| 6,848,994 | B1 * | 2/2005 | Knust | G06Q 20/04 273/148 R |
| D518,213 | S | 3/2006 | Ping | |
| 7,018,291 | B1 | 3/2006 | Lemke et al. | |
| 7,025,189 | B1 | 4/2006 | Petrusan | |
| 7,201,660 | B2 | 4/2007 | Kiely | |
| 7,351,145 | B1 | 4/2008 | Ornstein et al. | |
| 7,559,839 | B2 | 7/2009 | Bahar | |
| D628,199 | S | 11/2010 | Yukikado | |
| D628,913 | S | 12/2010 | Cheng | |
| D641,018 | S | 7/2011 | Lee | |
| D647,574 | S | 10/2011 | Zhang | |
| 8,157,643 | B1 | 4/2012 | Phan | |
| D669,076 | S | 10/2012 | Haller | |
| 8,282,480 | B2 | 10/2012 | Wells | |
| 8,430,733 | B2 | 4/2013 | Chang et al. | |
| 8,591,306 | B1 | 11/2013 | Kearns | |
| D698,353 | S | 1/2014 | Choi | |
| 8,814,681 | B2 | 8/2014 | Wells et al. | |
| 8,814,706 | B2 | 8/2014 | Wells et al. | |
| 8,968,086 | B2 | 3/2015 | Wells et al. | |
| D726,295 | S | 4/2015 | Kim | |
| 9,147,318 | B2 | 9/2015 | Tarantino | |
| 9,165,420 | B1 * | 10/2015 | Knust | G07F 17/3211 |
| 9,240,100 | B2 | 1/2016 | Tarantino | |
| 9,292,996 | B2 | 3/2016 | Davis et al. | |
| D761,901 | S | 7/2016 | Kim | |
| 9,489,799 | B2 | 11/2016 | Saffari et al. | |
| D778,279 | S | 2/2017 | Pendse | |
| 9,754,455 | B2 | 9/2017 | Tarantino | |
| D811,488 | S | 2/2018 | To et al. | |
| 9,940,779 | B2 | 4/2018 | To et al. | |
| D824,906 | S | 8/2018 | Feng et al. | |
| D826,228 | S | 8/2018 | Feng et al. | |
| 2002/0045480 | A1 * | 4/2002 | Soltys | G06Q 10/0639 463/29 |
| 2002/0120572 | A1 | 8/2002 | Bellucci | |
| 2003/0058372 | A1 | 3/2003 | Williams | |
| 2003/0060280 | A1 * | 3/2003 | Oles | G07F 17/32 463/29 |
| 2003/0089010 | A1 | 5/2003 | Wechter | |
| 2004/0033095 | A1 | 2/2004 | Saffari | |
| 2005/0026680 | A1 | 2/2005 | Gururajan | |
| 2006/0205498 | A1 | 9/2006 | Kogo | |
| 2008/0139274 | A1 | 6/2008 | Baerlocher | |
| 2008/0261699 | A1 | 10/2008 | Topham | |
| 2009/0075725 | A1 | 3/2009 | Koyama | |
| 2009/0082079 | A1 | 3/2009 | Kuhn | |
| 2009/0098932 | A1 | 4/2009 | Longway | |
| 2009/0253478 | A1 | 10/2009 | Walker | |
| 2010/0093429 | A1 * | 4/2010 | Mattice | G07F 1/06 463/25 |
| 2010/0178989 | A1 | 7/2010 | Kuhn | |
| 2010/0244380 | A1 | 9/2010 | Walker | |
| 2010/0291675 | A1 | 11/2010 | Pease | |
| 2011/0050602 | A1 | 3/2011 | Jeong et al. | |
| 2011/0195775 | A1 * | 8/2011 | Wells | G07F 9/026 463/29 |
| 2011/0195786 | A1 | 8/2011 | Wells | |
| 2011/0195792 | A1 | 8/2011 | Wells | |
| 2012/0094750 | A1 * | 4/2012 | Kuo | G07F 17/3241 463/29 |
| 2012/0208622 | A1 * | 8/2012 | Delaney | G07F 17/322 463/25 |
| 2014/0370989 | A1 | 12/2014 | Acres | |
| 2015/0014925 | A1 | 1/2015 | Miller | |
| 2015/0375096 | A1 | 12/2015 | Jackson | |
| 2016/0071367 | A1 | 3/2016 | Litman | |
| 2016/0093135 | A1 | 3/2016 | Bond | |
| 2016/0328913 | A1 | 11/2016 | Blazevic | |
| 2017/0330136 | A1 | 11/2017 | Bratter | |
| 2018/0005486 | A1 | 1/2018 | Risnoveanu | |
| 2018/0068517 | A1 * | 3/2018 | Drennan, III | A63F 13/98 |
| 2018/0189921 | A1 | 7/2018 | Feng | |
| 2018/0190063 | A1 | 7/2018 | Feng | |
| 2018/0190064 | A1 | 7/2018 | Feng | |
| 2019/0005768 | A1 * | 1/2019 | Wilkinson | H04N 7/188 |
| 2019/0164381 | A1 | 5/2019 | Feng | |

OTHER PUBLICATIONS

Notice of Allowance for U.S. Appl. No. 29/615,741, dated May 22, 2018.
Office Action for U.S. Appl. No. 15/396,308, dated Sep. 21, 2018.
Final Office Action for U.S. Appl. No. 15/396,308, dated Feb. 27, 2019.
Office Action for U.S. Appl. No. 15/396,342, dated Apr. 12, 2019.
Restriction Requirement for U.S. Appl. No. 15/688,841, dated Mar. 4, 2019.
Office Action for U.S. Appl. No. 15/826,680, dated May 16, 2019.
Karami et al., "Image Matching Using SIFT, SURF, BRIEF and ORB: Performance Comparison for Distorted Images", In Proceedings of the 2015 Newfoundland Electrical and Computer Engineering Conference,St. johns, Canada, Nov. 2015.
Office Action for U.S. Appl. No. 15/688,841, dated Jul. 15, 2019.
Office Action for U.S. Appl. No. 15/396,308, dated Sep. 23, 2019.
Final Office Action for U.S. Appl. No. 15/396,342, dated Oct. 10, 2019.
Office Action for U.S. Appl. No. 15/826,680, dated Nov. 25, 2019.
Office Action for U.S. Appl. No. 16/200,636, dated Dec. 17, 2019.
Notice of Allowance for U.S. Appl. No. 15/688,841, dated Mar. 2, 2020.
Advisory Action for U.S. Appl. No. 15/826,680, dated Mar. 9, 2020.
Final Office Action for U.S. Appl. No. 15/396,308, dated Mar. 23, 2020.
Final Office Action for U.S. Appl. No. 16/200,636, dated Apr. 2, 2020.

* cited by examiner

TOKEN REPOSITORY APPARATUS WITH ATTRIBUTE CAPTURE AND METHODS THEREFOR

CROSS REFERENCE TO RELATED APPLICATION

This application claims priority to U.S. Patent Provisional Application Ser. No. 62/658,551, filed Apr. 16, 2018, and entitled "TOKEN REPOSITORY APPARATUS WITH ATTRIBUTE CAPTURE AND METHODS THEREFOR," which is incorporated herein for all purposes.

BACKGROUND OF THE INVENTION

Today, gaming establishments, such as casinos, operate gaming apparatus, such as gaming tables that provide casino table games. Casino table games are games of chance, such as Poker, Roulette, Black Jack, Craps, Baccarat, etc., often involve players sitting at a physical table using physical game objects (cards, dice, chips, etc.) to play the games.

To support such gaming tables, gaming establishments need to provide various support personnel as well as gaming supplies to gaming tables. For example, a gaming establishment might employ a full supporting staff of dealers, pit bosses, shift managers, cashier clerks, chip runners, waiters, service technicians, etc. to support its gaming tables.

In wagering on games of chance, a player sitting at a gaming table can place one or more bets by placing one or more chips at designated positions on the gaming table. Moreover, side bets can also often be placed on a result of the game of chance. These side bets can be from any of the players sitting at the gaming table or other persons standing nearby that are able to place a side bet. It is difficult and time consuming for dealers to receive, confirm and manage all such bets. Also, some games of chance at the gaming table can requirement of a commission that the dealer is to extract chips from the pot of wagers. It is also difficult for dealers and/or gaming establishments to manage recording and accounting for such commissions.

Accordingly, there is a need for improved approaches to assist players and/or dealers to receive, confirm and manage chips being used at a gaming table operating a game of chance (e.g., casino table game).

SUMMARY

Embodiments disclosed herein concern a token repository apparatus that can facilitate management of tokens. The token repository apparatus that can receive tokens, capture attributes of the tokens, and retain the tokens in a repository. For example, the tokens can be gaming tokens, and the token repository apparatus can be coupled to a multi-player gaming apparatus (e.g., gaming table) supporting wager-based games. Advantageously, tokens, such as pertaining to table commissions or dealer tips, can be securely and reliably deposited. The captured attributes pertaining to the tokens can be used to validate the tokens being deposited. The attributes captured can be acquired by way of images and/or other metadata pertaining to the tokens. The token repository apparatus can also facilitate recording of values of the various gaming tokens being deposited.

A token repository apparatus can be used with a gaming table that provides wager-based games and that is supported by various electronic devices or appliances. Typically, the various electronic devices can be coupled together via a table network and then coupled to a central network having computerized or computer assisted game management systems. In one embodiment, a live dealer at the gaming table has access to a token repository apparatus. In another embodiment, each player position can have its own token repository apparatus. The token repository apparatus not only can provide a repository for tokens but also can assist a gaming establishment in confirming or tracking commissions for wager-based table games or tips from players.

The invention can be implemented in numerous ways, including as a method, system, device, apparatus (including computer readable medium and graphical user interface). Several embodiments of the invention are discussed below.

As a gaming token apparatus, one embodiment can, for example, include at least: an input and evaluation portion configured to receive a token and to evaluate the token; and a token repository coupled to the input and evaluation portion, the token repository receiving tokens that pass through the input and evaluation portion.

As a method for accepting gaming tokens, one embodiment can, for example, include at least: receiving a gaming token into a token entry opening of a token repository apparatus; directing the gaming token to an imaging position; stopping the gaming token at the imaging position; capturing an image of at least a portion of the gaming token while the gaming token is stopped at the imaging position; and releasing the gaming token from the imaging position after the image of the at least a portion of the gaming token has been captured.

As a method for processing gaming tokens at a gaming token apparatus, one embodiment can, for example, include at least: receiving a gaming token into a token entry opening of the gaming token apparatus; directing the gaming token to an imaging position; illuminating a light source at least for a period of time while the gaming token is at the imaging position; capturing an image of at least a portion of the gaming token; ceasing the illuminating of the light source after the image of the at least a portion of the gaming token has been captured; directing the gaming token to a token repository of the gaming token apparatus; and thereafter receiving the gaming token in the token repository.

As a computer readable medium including at least computer program code stored therein for processing gaming tokens for a token management apparatus, which includes an evaluation portion and a repository portion, one embodiment can, for example, include at least: computer program code for detecting a gaming token at the evaluation portion internal to the token management apparatus; computer program code for initiating illumination of a light source at least for a period of time while the gaming token is at the evaluation portion; computer program code for initiating capturing an image of at least a portion of the gaming token; computer program code for ceasing the illumination of the light source after the image of the at least a portion of the gaming token has been captured; and computer program code for permitting the gaming token to be received in the repository portion.

As a wagering table for supporting wager-based table games, one embodiment can, for example, include at least: a table surface providing a gaming surface for a wager-based table game, the table surface supporting a plurality of player positions provided about the table surface; a plurality of electrical devices provided at or proximate to said wagering table, the plurality of electrical devices supporting the wager-based table game; a table controller configured to control the plurality of electrical devices; and a gaming token repository apparatus. The gaming token repository apparatus can, for example, include at least an input and evaluation portion configured to receive a token and to evaluate the token, and a token repository coupled to the input and evaluation portion, the token repository receiving tokens that pass through the input and evaluation portion.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like elements, and in which.

DETAILED DESCRIPTION OF CERTAIN EMBODIMENTS

Figure 1:
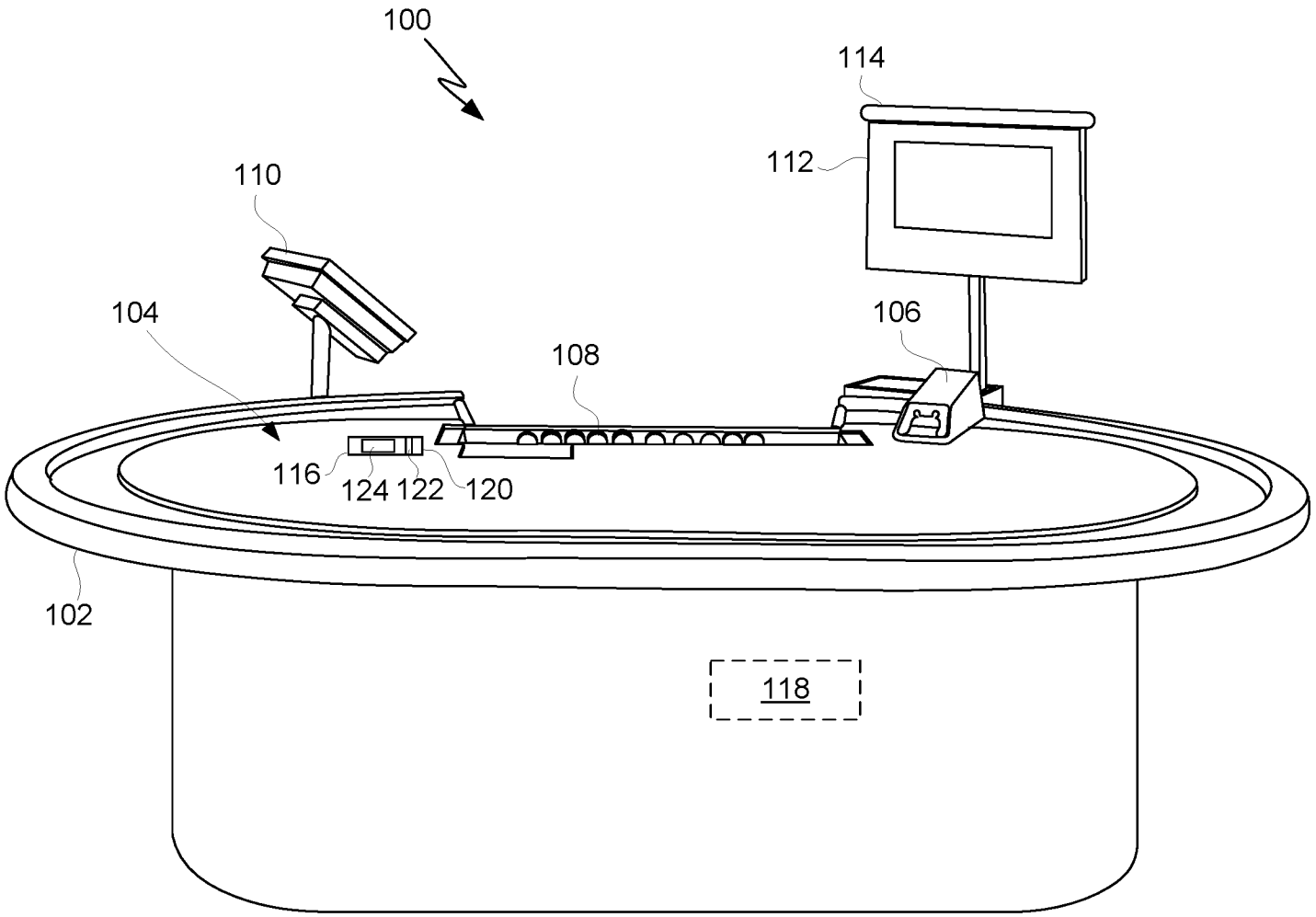
FIG. 1 is a perspective view of a gaming apparatus according to one embodiment.

Embodiments disclosed herein concern a token repository apparatus that can facilitate management of tokens. The token repository apparatus can receive tokens, capture attributes of the tokens, and retain the tokens in a repository. For example, the tokens can be gaming tokens, and the token repository apparatus can be coupled to a multi-player gaming apparatus (e.g., gaming table) supporting wager-based games. Advantageously, tokens, such as pertaining to table commissions or dealer tips, can be securely and reliably deposited. The captured attributes pertaining to the tokens can be used to validate the tokens being deposited. The attributes captured can be acquired by way of images and/or other metadata pertaining to the tokens. The token repository apparatus can also facilitate recording of values of the various gaming tokens being deposited.

In one embodiment, a token repository apparatus can include an input and evaluation portion configured to receive a token and to evaluate the token. The token repository apparatus can also include a token repository configured to receive tokens that pass through the input and evaluation portion. In one implementation, the gaming token apparatus can also include a token entry opening configured to receive a gaming token, and a channel configured to guide the received gaming token between the token entry opening and the token repository through the input and evaluation portion. In the same or another implementation, the input and evaluation portion can include: (i) a token detector positioned to detect presence of a gaming token at the input and evaluation portion, (ii) a token stop actuator configured to controllable temporarily stop the gaming token at the input and evaluation portion, (iii) a camera for capturing at least one image of the gaming token temporarily stopped at the input and evaluation portion, and (iv) a controller operable to determine presence of the gaming token at the input and evaluation portion based on the token detector, control the token stop actuator to temporarily stop the gaming token at the input and evaluation portion, and control the camera to capture of the at least one image of the gaming token temporarily stopped at the input and evaluation portion.

A token repository apparatus can be used with a gaming table that provides wager-based games and that is supported by various electronic devices or appliances. Typically, the various electronic devices can be coupled together via a table network and then coupled to a central network having computerized or computer assisted game management systems. In one embodiment, a live dealer at the gaming table has access to a token repository apparatus. In another embodiment, each player position can have its own token repository apparatus. The token repository apparatus not only can provide a repository for tokens but also can assist a gaming establishment in confirming or tracking commissions for wager-based table games or tips from players.

Embodiments of various aspects of the invention are discussed below with reference to FIGS. 1-10. However, those skilled in the art will readily appreciate that the detailed description given herein with respect to these figures is for explanatory purposes as the invention extends beyond these limited embodiments.

FIG. 1 is a perspective view of a gaming apparatus 100 according to one embodiment. The gaming apparatus 100 in this embodiment is a gaming table. However, more generally, the gaming apparatus is an apparatus that supports a game of chance, such as a wager-based game or a skill-based game, or some combination thereof. Examples of gaming apparatus include gaming tables and slot machines.

The gaming table has a table top 102 that supports various player positions around a table surface 104. The gaming apparatus 100 can include an electronic card shoe 106, a chip tray 108, a dealer terminal 110, a table display 112, and an edge display 114. The gaming apparatus 100 can also include one or more token repository apparatus 116. For example, as shown in FIG. 1, the gaming apparatus 100 can provide the token repository apparatus 116 at or proximate to a dealer position of the table top 102. Alternatively or additionally, the token repository apparatus 116 can be for each of a plurality of player positions around the table top 102. The one or more token repository apparatus 116 can serve to assist players and/or dealers with depositing tokens, namely, gaming tokens (i.e., chips), in a token repository.

The gaming apparatus 100 can also include a gaming apparatus control system 118 that controls electronic operations at the gaming apparatus 100, including interaction with the token repository apparatus 116. The gaming apparatus control system 118 is an electronic apparatus that can be programmed to provide various functions. Among other functions, as discussed below, the gaming apparatus control system 118 can interact with the token repository apparatus 116. The gaming apparatus 100 can be referred to as an electronic gaming table since it makes use of a gaming table as well as various electronic devices.

The token repository apparatus 116 can include a top cover 120 that is provided over an opening in the table surface 104 at or proximate to the dealer position of the table top 102. The top cover 120 includes a token opening (e.g., slot) 122 for receiving a token (e.g., chip). The top cover 120 can also include a display 124 that can display information to a user (e.g., dealer). The information displayed can, for example, indicate the value of a token that has been deposited into the token opening 122.

The gaming apparatus 100 can support play of a game of chance, such as a wager-based game or a skill-based game, or some combination thereof. The gaming apparatus 100 can generally utilize gaming supplies in providing games of chance. The gaming supplies can include various gaming supplies that might be available for use at the gaming apparatus 100 to support a game of chance. For example, the gaming supplies include cash, cards and/or tokens (e.g., chips).

The gaming apparatus control system 118 can also provide electronic monitoring and/or management of the gaming apparatus 100 including (i) use of gaming supplies, bets, wins, and (ii) presenting (e.g., displaying) information to interested persons, such as player, dealers or managers, of gaming related information or dealer-related information. In doing so, the gaming apparatus control system 118 can include or couple to various electrical devices, such as a controller, sensors, displays, touch screens, buttons, lights, cameras, display interfaces, network interface(s), electronic support appliances (e.g., electronic shoe for cards, shuffler, card reader, chip tray, voucher printer, bill validator and the like), etc.

The gaming apparatus control system 118 can also provide or support multiple display devices to present information to interested persons. For example, the display devices can include (i) an apparatus display screen that can present information pertain to gaming currently or previously undergone at the gaming apparatus 100, often can also present near-term historical information, (ii) a player display for each player, and/or (iii) a messaging display often provided adjacent or proximate to the apparatus display. In one embodiment, a player display can provide notification or messages to players with text, images or colored lighting. In one embodiment, a messaging display can present its message with light sources that offer substantially greater intensity that light provided by the apparatus display screen. Advantageously, a message conveyed by the messaging display can be able to be seen and understood from a significant distance away (e.g., 20-120 feet), whereas the information presented by the apparatus display is designed for nearby persons (e.g., less than 15 feet). Further, as discussed herein, the electronic betting assistant 116 can also, in some embodiments, include a display device that presents information to a player.

The gaming apparatus 100 can also include a camera that can be directed towards the token repository apparatus 116. Such camera can be controlled to capture one or more images or a short video clip of a token being dropped into the token repository apparatus 116. The images or video clip can be time stamped and stored for auditing purposes.

Figure 2:
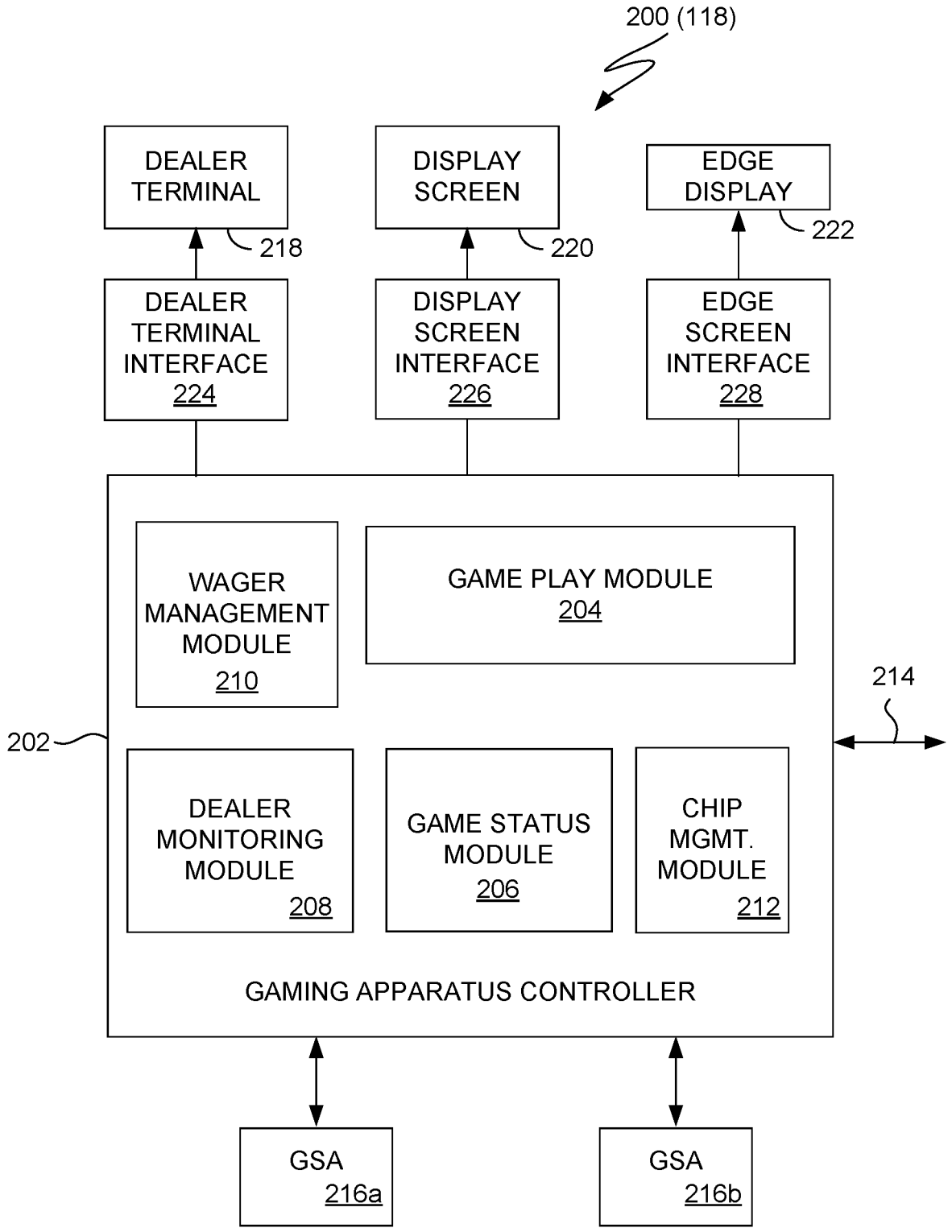
FIG. 2 is a block diagram of a gaming apparatus control system according to one embodiment.

FIG. 2 is a block diagram of a gaming apparatus control system 200 according to one embodiment. The gaming apparatus control system 200 is, for example, suitable for use as the gaming apparatus control system 118 illustrated in FIG. 1. Typically, the gaming apparatus control system 200 is associated with a gaming apparatus, such as the gaming apparatus 100 illustrated in FIG. 1. The gaming apparatus control system 200 includes a gaming apparatus controller 202 that controls overall operation at the gaming apparatus to which the gaming apparatus control system 200 is coupled. The gaming apparatus controller 202 is an electronic device that can include various functional components, such as modules, that are used by the gaming apparatus control system 200 to perform various operations.

As illustrated in FIG. 2, the gaming apparatus controller 202 can include a game play module 204, a game status module 206 and a dealer monitoring module 208. The game play module 204 can, for example, serve to manage game play at the gaming apparatus associated with the gaming apparatus control system 200. The game status module 206 can monitor status of one or more wager-based games being performed at the gaming apparatus. For example, the game status module 206 could monitor game state (of wager-based game), gaming supplies, player stats, dealt cards, winners, winning streaks, and the like. The dealer monitoring module 208 can, for example, monitor dealer status. In one embodiment, the gaming apparatus supports the play of one or more wager-based games that are operated by a dealer resident at the gaming apparatus (so called "live dealer"). Hence, the dealer monitoring module 208 can additionally or alternatively serve to monitor the status of the dealer, such as dealer performance, dealer breaks, dealer requests, dealer shift changes, and the like.

The gaming apparatus controller 202 can also include a wager management module 210. The wager management module 210 can assist a dealer and/or player with placing wagers (bets) at the gaming apparatus. For example, the wager management module 210 can coordinate play of wager-based games by various players, facilitate receipt and confirmation of wagers by players, facilitate confirmation and acceptance of wagers by a dealer, and/or monitor performance of such wagers. The wagers being placed can be for a primary game at the gaming apparatus, a side bet at the gaming apparatus, or even an auxiliary bet on a wager-based game operating on another gaming apparatus.

The gaming apparatus controller 202 can also include a token management module 212. The token management module 212 can interact with a token repository apparatus, such as the token repository apparatus 116, to control, manage and/or monitor tokens being deposited into the token repository apparatus 116. That is, the token management module 212 can assist the processing capabilities of the token repository apparatus 116 or can operate the token repository apparatus 116 as a peripheral device.

The gaming apparatus controller 202 can support token repository apparatus, such as the token repository apparatus 116 shown in FIG. 1. The token repository apparatus is an electro-mechanical device that can be used to receive tokens (e.g., chips) from a user (e.g., dealer, player, etc.). The tokens being received can be analyzed to determine their value (i.e., monetary value) and/or their validity (e.g., mitigate fraud). In one embodiment, the token repository apparatus can includes one or more electronic sensors that serve to capture data that can be evaluated to make a determination of the value and/or authenticity of the token(s). For example, the electronic sensors can include one or more of a weight sensor (e.g., electronic scale), a diameter sensor, a proximity sensor, and an image sensor (e.g., camera). In some embodiments, the token repository apparatus can also include a notification component, such as a display or illumination elements, to provide notifications (e.g., illumination of graphics and/or text) to a player or dealer.

The gaming apparatus controller 202 can also be coupled to a central gaming server via a network link 214. The network link 214 can represent one or more networks and/or one or more network links, whether wired or wireless.

The gaming apparatus controller 202 can also be assisted by one or more gaming support appliances 216. The gaming support appliances 216 can couple to the gaming apparatus controller 202 by either wired or wireless means. Examples of gaming support appliances include an electronic shoe, an electronic lock, an electronic chip tray, electronic betting assistants, voucher printer, electronic card shuffler, etc. As shown in FIG. 2, the gaming apparatus control system 200 includes gaming support appliance 216*a* and gaming support appliance 216*b*. The token repository apparatus can also be considered a gaming support appliance.

The gaming apparatus control system 200 can convey information to a dealer, managers, or players (including potential players, i.e., bystanders). To do so, the gaming apparatus control system 200 can support one or more display devices. In the embodiment illustrated in FIG. 2, the gaming apparatus control system 200 supports a dealer terminal 218, a display screen 220, and an edge display 222. These display devices can be individually controlled to provide pertinent information to the dealer, managers, or players. For example, the dealer terminal 218 can display information suitable or useful for the dealer operating the gaming apparatus. The display screen 220 can display information suitable or useful for the players that are playing wager-based games at the gaming apparatus. For example, the display screen 220 can display wins, winning streaks, bets, and various other gaming related data. The edge display 222 can display information suitable for anyone in the vicinity of the gaming apparatus, which can include the dealer, players and managers.

In order to control the display devices, the gaming apparatus control system 200 can further include a dealer terminal interface 224, a display screen interface 226 and an edge display interface 228. The dealer terminal interface 224 provides an interface to the dealer terminal 218. The display screen interface 226 provides an interface to the display screen 220. The edge display interface 228 provides an interface to the edge display 222. These interfaces can facilitate control over what information is presented on the various display devices. The interfaces can, for example, include controllers, drivers, memory, and the like. Although the various interfaces and display screens are shown separately, in other embodiments it is possible that one or more of these interfaces and/or displays can be integrated together, shared or provided adjacent one another.

Figure 3:
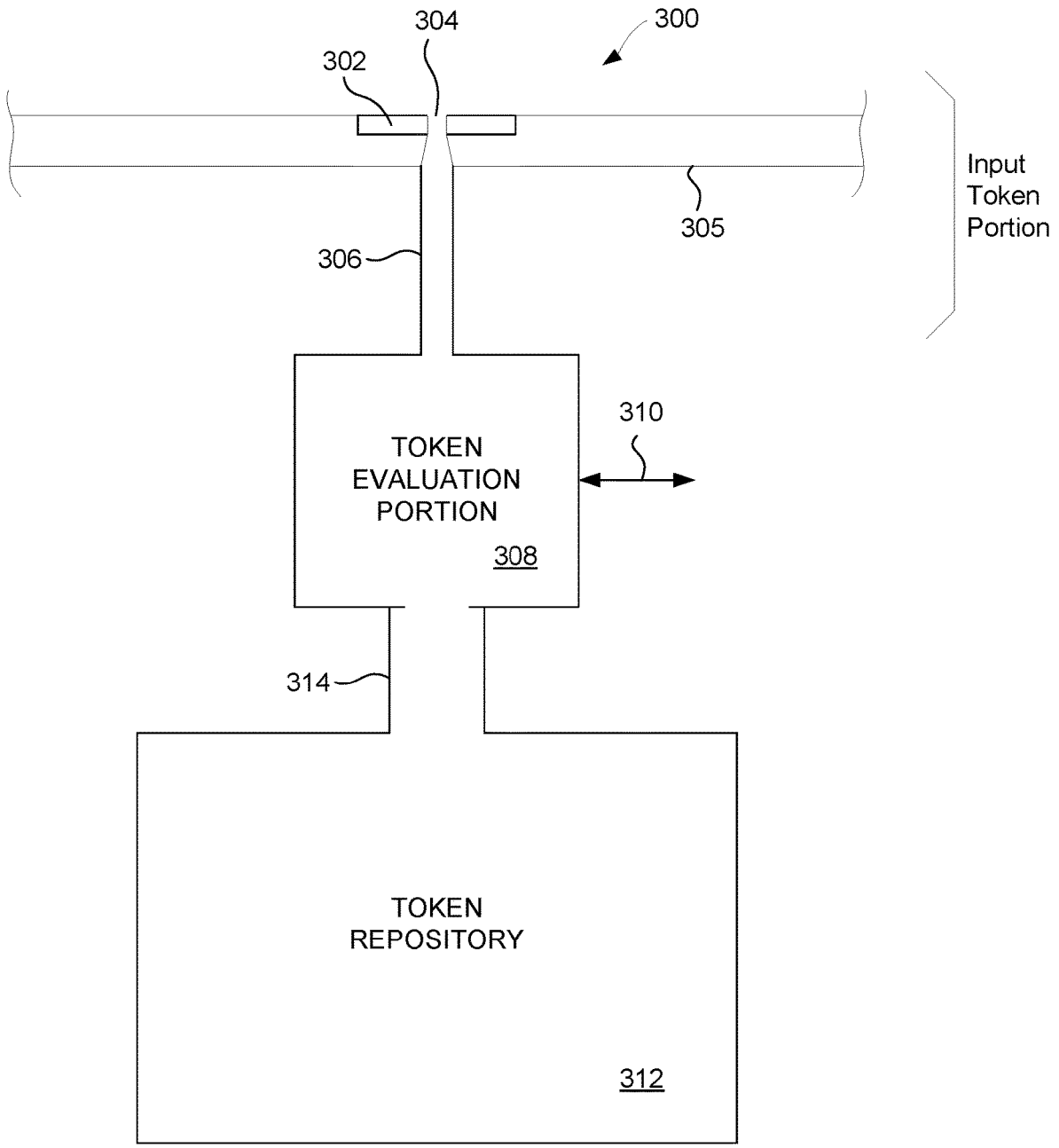
FIG. 3 is block diagram of a token repository apparatus according to one embodiment.

FIG. 3 is block diagram of a token repository apparatus 300 according to one embodiment. The token repository apparatus 300 is, for example, suitable for use as the token repository apparatus 116 illustrated in FIG. 1.

The token repository apparatus 300 includes a token input portion that is configured to receive a token that is being deposited into the token repository apparatus 300. The token input portion can include a cover 302 having a token opening 304. The cover 302 provides a user exposed surface for the token repository apparatus 300. The cover 402 is typically provided on or in a surface 305 of a gaming apparatus.

The token input portion can also include a channel 306 through which the received token can pass. The token repository apparatus 300 can also include a token evaluation portion 308. The received token arrives at the token evaluation portion 308 via the channel 306. At the token evaluation portion 308, the received token can be evaluated so as to acquire one or more attributes of the received token.

The token evaluation portion 308 can include one or more electrical components, such as sensors, controllers, etc. The token evaluation portion 308 can also couple to a network and/or power via a cable 310. The one or more electrical components can operate to capture one or more attributes of the received token. The token evaluation portion 308 can also operates, locally or with remote assistance, to validate the received token. The validation might determine that the received token is a legitimate token of a particular gaming establishment, and/or determine a value (e.g., monetary value) of the received token. After any evaluation in the token evaluation portion 308, the receive token can be received in a token repository 312. The token repository 312 can be positioned below the token evaluation portion 308 and may be mechanically interconnected with a channel 314 though which received token can pass. The token repository 312 can be a container that retains received token. In one implementation, the container can be removable from the token repository apparatus 300.

In one implementation, the surface 305 can be a table surface of a gaming table of a table-based gaming apparatus. In such case, the gaming table (structure 304) can include an opening configured to receive the cover 302 or housing of the token repository apparatus 300. The token opening 304 of the cover 302 of the token repository apparatus 300 can receive a token being deposited. The validity and/or value of the received token can then be determined by the token evaluation portion 308, alone or with assistance of other electrical devices. In one implementation, the cover 302 of the electronic betting assistant 302 can be substantially flush or planar with an exposed upper surface of the surface 305 (e.g., playing surface of gaming table).

Figure 4A:
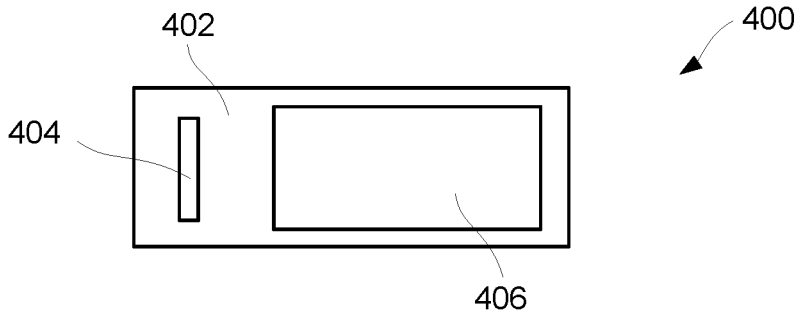
FIG. 4A is top view of a token repository apparatus according to one embodiment.

FIG. 4A is top view of a token repository apparatus 400 according to one embodiment. The token repository apparatus 400 is suitable for use as the token repository apparatus 116 illustrated in FIG. 1.

The token repository apparatus 400 includes a cover 402 that provides a top surface for the token repository apparatus 400. The cover 402 is typically provided on a table surface of a gaming table. The cover 402 provides a uniform outer surface for the token repository apparatus 400. In one embodiment, the cover 402 can be non-transparent, transparent or semi-transparent. For example, the cover 402 can be glass, plastic, wood, metal, etc.

The cover 402 includes a token opening 404 for receiving tokens that are being deposited into the token repository apparatus 400. The token opening 404 is, for example, a slot. Typically, the token opening 404 is configured to be slightly larger than a largest size (e.g., diameter and/or width) of those tokens that are eligible to be received. In one implementation, the token opening 404 is a slot, which can be tapered to facilitate orientation of the token being deposited into the token opening 404.

The cover 402 can also support a display device 406 that can display information to a user. For example, the display device 406 might display information, such as a value of a deposited token, an indication of whether a deposited token is valid, an accumulated value of tokens deposited, etc. More specifically, the display device 406 can display information that can be referred to as status information, which can include any of token present, token valid, token invalid, token denomination, token identifier, etc.

In an alternative embodiment, the cover 402 need not include the display device 406. In such an embodiment, the display device can be implemented as a separate display that is proximate to the token repository apparatus. In another embodiment, the token repository apparatus t can be supported by both table display, a dealer display or a community display, or any other display proximate thereto.

Figure 4B:
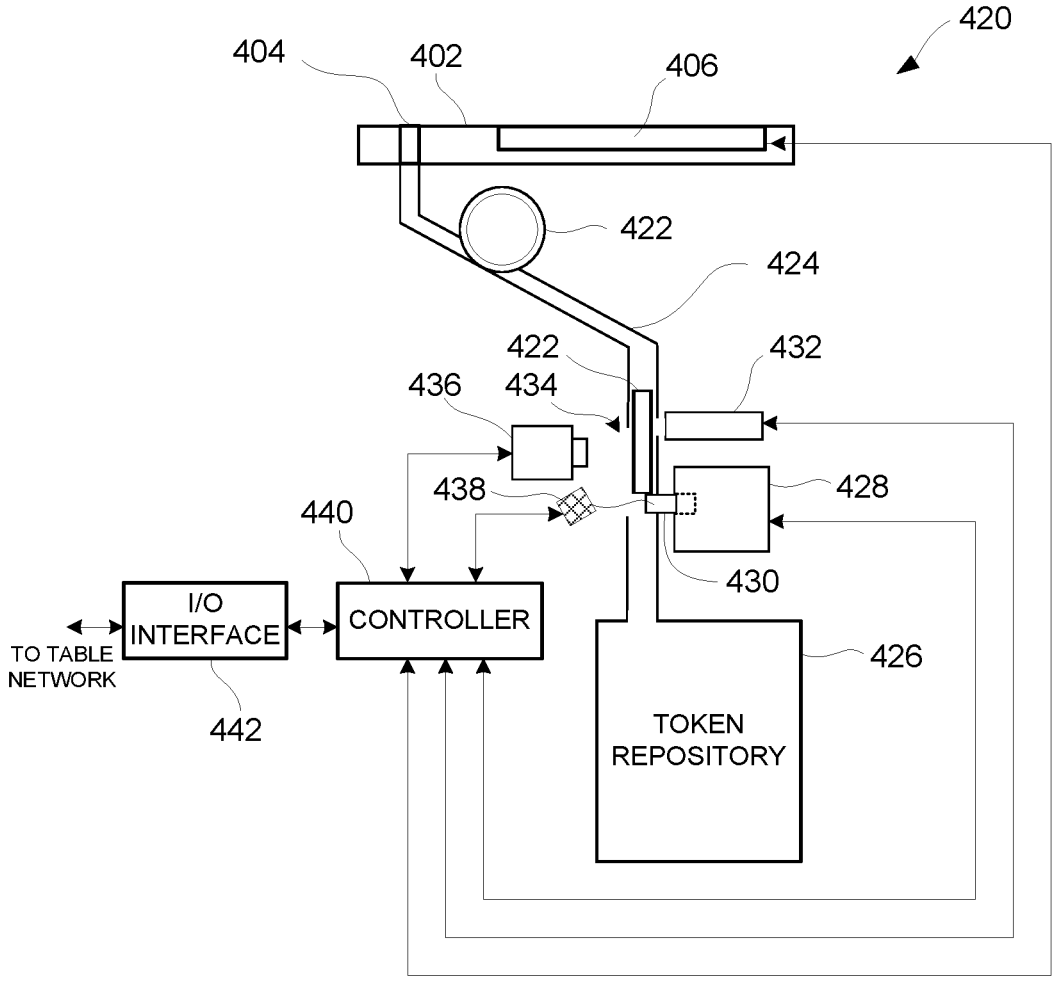
FIG. 4B is schematic diagram of a token repository apparatus according to one embodiment.

FIG. 4B is schematic diagram of a token repository apparatus 420 according to one embodiment. The token repository apparatus 420 is suitable for use as the token repository apparatus 116 illustrated in FIG. 1, or the token repository apparatus 400 illustrated in FIG. 4A.

The token repository apparatus 420 includes a cover 402. The cover 402 is, for example, the same as the cover 402 illustrated in FIG. 4A. As such, the cover 402 illustrated in FIG. 4B includes the token opening 404 and the display device 406.

When a token 422 is received at the token opening 404, the token 422 can be directed by a channel 424 to an evaluation area internal to the token repository apparatus 420. In general, the channel 424 can direct the token 422 from the token opening 404 towards a token repository 426. The token repository 426 is a storage container for tokens. The token repository 426 can be removable from the token repository apparatus 424 and/or can have an access door for the removal of previously deposited tokens.

Before the token 422 is received at the token repository 426, the token 422 passes into an evaluation region internal to the token repository apparatus 420. A token stop actuator 428 can be controlled to insert or remove a protrusion 430 into the channel 424. When the protrusion 430 is inserted into the channel 424, the protrusion 430 acts as a gate that stops the token 422 at the evaluation region. A token detector 432 can be used to determine that the token 422 is currently present at the evaluation region. The channel 424 can also include at least one opening 434 to facilitate evaluation of the token 422 that is present at the evaluation region (e.g., even though still retained in the channel). A camera 436 can acquire at least one image of at least a portion of the token 422. The camera 436 can acquire the at least one image via the at least one opening 434. Additionally, a light source 438 can be controlled to illuminate at least a portion of the token 422 at the evaluation region. The light source 438 can be activated prior to the camera 436 seeking to acquire the at least one image of the token 422. After the camera 436 has acquired the at least one image, the light source 438 can be deactivated.

The token repository apparatus 420 also includes a controller 440. The controller 440 controls the operation of the various electrical components contained within the token repository apparatus 420. In this regard, the controller 440 can interact with the token detector 432 to detect the presence of the token 422. The controller 440 can also control operation of the token stop actuator 428 to controlled position of the protrusion 430 such that the protrusion 430 blocks the channel 424 so that the token 422 can be evaluated prior to being permitted to pass to the token repository 426. Further, the controller 440 can operate to illuminate the light source 438 (e.g., as needed) and then activate the camera 436 to capture the one or more images of the token 422. After the camera 436 has successfully captured the one or more images of the token 422, subject to possible validation and or authentication processing, the controller 440 can interact with the token stop actuator 428 to retract the protrusion 430 and permit the token 422 to pass into the token repository 426. Still further, the controller 440 can interact with the display device 406 to cause information to be presented for the benefit of a user of the token repository apparatus 420.

The token repository apparatus 420 can also include an input/output (I/O) interface 442. The I/O interface 442 can interact with a table network, such as provided by a gaming table, to which the token repository apparatus is coupled. The I/O interface 442 can interact with the controller 440 such that computing resources (e.g., gaming apparatus control system 118 and/or remote servers) available via the table network can be utilized by the controller 440. For example, in order to provide validation and/or authentication of the token 422, image processing or other attribute processing associated with the token 422 can be performed either at the controller 440, at a gaming apparatus control system or at a remote processing resource, or some combination thereof. The image processing can perform image matching of the captured image(s) with one or more reference images to authenticate or validate a token. Example of image matching techniques include SIFT, SURF and ORB, and may use different kinds of transformations and deformations such as scaling, rotation, noise, fish eye distortion, and shearing.

Additionally, although not shown in FIG. 4B, various additional sensors or detectors can be provided within the token repository apparatus 420 to facilitate acquisition of additional metadata pertaining to various attributes of the token 422. As examples, the sensors or detectors can include one or more of optical sensor, infrared (IR) sensor, ultraviolet (UV) sensor, RFID sensor, etc. For example, the token repository apparatus 420 could include a weight detector (e.g., electronic scale) suitable for detecting a weight of the token 422. As another example, the token repository apparatus 420 could include a pattern reader suitable for reading a pattern (e.g., barcode) provided on a token 422. Is still another example, the token repository apparatus 420 could include a size detector for a token 422. For example, the size detector could detect a diameter of the token 422. Any of the metadata could be used in validating or authenticating the token 422. The metadata can, for example, pertain to size (e.g., diameter or thickness), color, reflectivity, hidden codes, identifiers, etc. Additional metadata can also be acquired, such as time/date stamp, associated gaming establishment, gaming apparatus identifier, token repository apparatus identifier, dealer identifier, etc.

The token repository apparatus 420 could also include a token direction sensor. The token direction sensor can be used to prevent fraud in which token are manipulated to be moved in a direction unintended.

The token repository apparatus 420 can also include a memory device to store captured data (e.g., metadata) pertaining to the token 422. The memory device can be non-volatile memory, such provided by a NV-RAM, solid state memory, or hard drive. The captured data being stored can be encrypted before being stored.

In another embodiment, the token repository apparatus can include (i) a chip ramp that can be angled just enough to allow chips to roll down ramp to plunger and drop chute; (ii) a chip sensor, such as an infra-red (IR) beam sensor consisting of an IR emitter/receiver, which can serve to detects when a chip is in position at stop position; (iii) a camera, such as a CCD camera with a wide angle lens and ring light for illumination; and (iv) plunger pull solenoid mechanism, such as a small electric pull solenoid that can extend at rest to hold a chip at the stop position and operates as a chip gate lever of a chip gate, and when energized retracts allowing the chip to leave the stop position. Such an embodiment can operate in four basic states. At idle, the solenoid's plunger is de-energized and extended, and no chip present as per the chip sensor. At chip detected (after user drops chip into token repository apparatus), chip rolls down ramp and comes to rest against the chip gate (i.e., at stop position), and the camera captures image of the chip and a controller can process or transmit the image for external processing. At release, solenoid's plunger is retracted by energizing the solenoid mechanism, and thus the chip gate is removed or opened. At chip exit, the chip rolls into drop chute and on to a repository, and in doing so the chip clears the chip sensor which can then de-energize the solenoid mechanism so as to extend the chip gate to thus stop the next chip at the stop position. The processing can then repeat for the next chip.

Figure 4C:
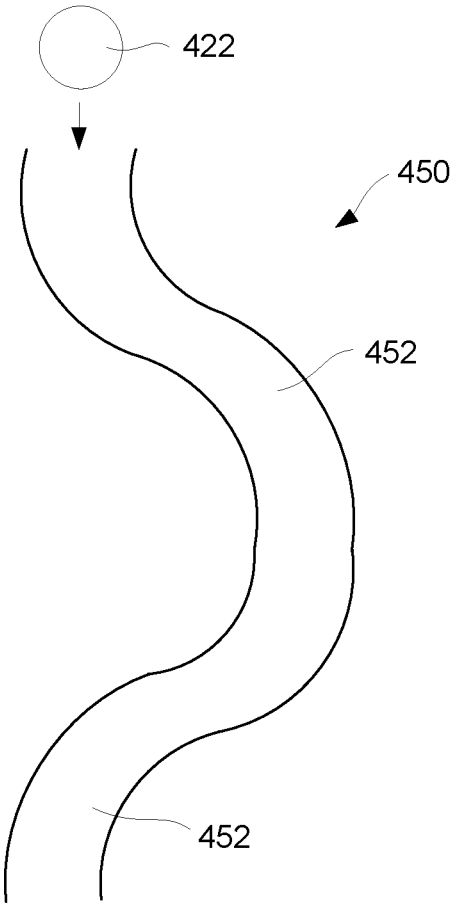
FIGS. 4C and 4D illustrates a token delivery configuration according to one embodiment.
Figure 4D:
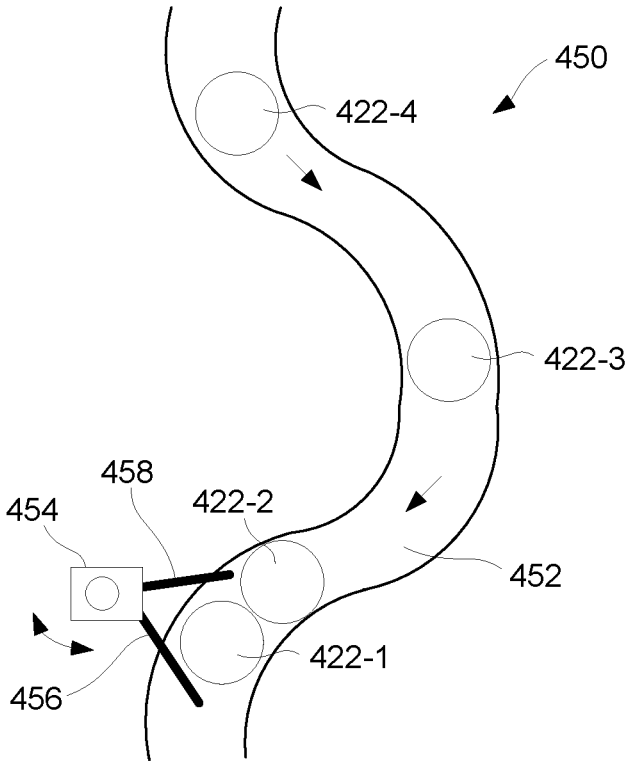

FIGS. 4C and 4D illustrates a token delivery configuration 450 according to one embodiment. The token delivery configuration 450 can be used with the token repository apparatus 420 illustrated in FIG. 4B. such as within or in-line with the channel 424. In an alternative embodiment, the token delivery configuration 450 can be used with the token repository apparatus 300 illustrated in FIG. 3, such as in the token input portion.

The token delivery configuration 450 can include a token path 452 for the token 422. The token path 452 can be included within or by adjacent to the channel 424. In this embodiment, the token path 452 is a curvilinear path, such as a curved path. The pattern of the token path 452 can be a "S" shape, a "C" shape, or a serpentine shaped path. The token path 452 allows for multiple tokens 422 to be queued such that the tokens 422 can be subsequently sequentially evaluated, such as at the evaluation portion of the token repository apparatus 400.

As shown in FIG. 4D, the token delivery configuration 450 can also include a token singulator 454. The token singulator 454 can be electronically controlled to release one queued token at a time. The token singulator 454 can not only singulate the queued tokens 422 but also can prevent tokens from being removed after insertion into the token path 452.

The token singulator 454 can include at least one extended element 456 (e.g., arm) that can be positioned at least partially within the token path 452 to stop a current token from passing through the token path 452 until desired. When the token repository apparatus 420 is ready to process a next token, the token singulator 454 can be activated. When activated, the token singulator 454 can rotate to permit a single token 422 to pass while impeding or blocking subsequent ones of the queued tokens 422. For example, when activated, the token singulator 454 can rotate forward to allow a current token 422-1 to pass while blocking a next token 422-2 (as well as subsequent tokens 422-3 and 422-4) from passing. The token singulator 454 can also prevent the token 422 that has been passed to be retrieved and withdrawn through the token path 452, such as in a reverse direction through the token path 452. When the token singulator 454 rotates, an extended element 456 can rotate out of the token path 452 to allow the current token 422-1 to pass through the token path 452. The controller 440 shown in FIG. 4B can be used to control rotation of the token singulator 454. The token singulator 454 can also include another extended element 458 that can provide blocking of the next token 422-2 while the current token 422-1 is released.

In one implementation, the token singulator 454 can be controlled to rotate forward and then back using the extended elements 456 and 458 shown in FIG. 4D. In another implementation, a token singulator can include a gear-type structure with multiple extended elements, and as the token singulator is controllable rotated in a forward direction, a single token can be released while blocking passage of subsequent tokens. For example, the token singulator could include a tri-lobed gear.

Although not shown, the token delivery configuration 450 can also include one or more sensors, such as discussed herein. For example, the token delivery configuration 450 could include a diameter sensor to check a diameter of a token.

Figure 5:
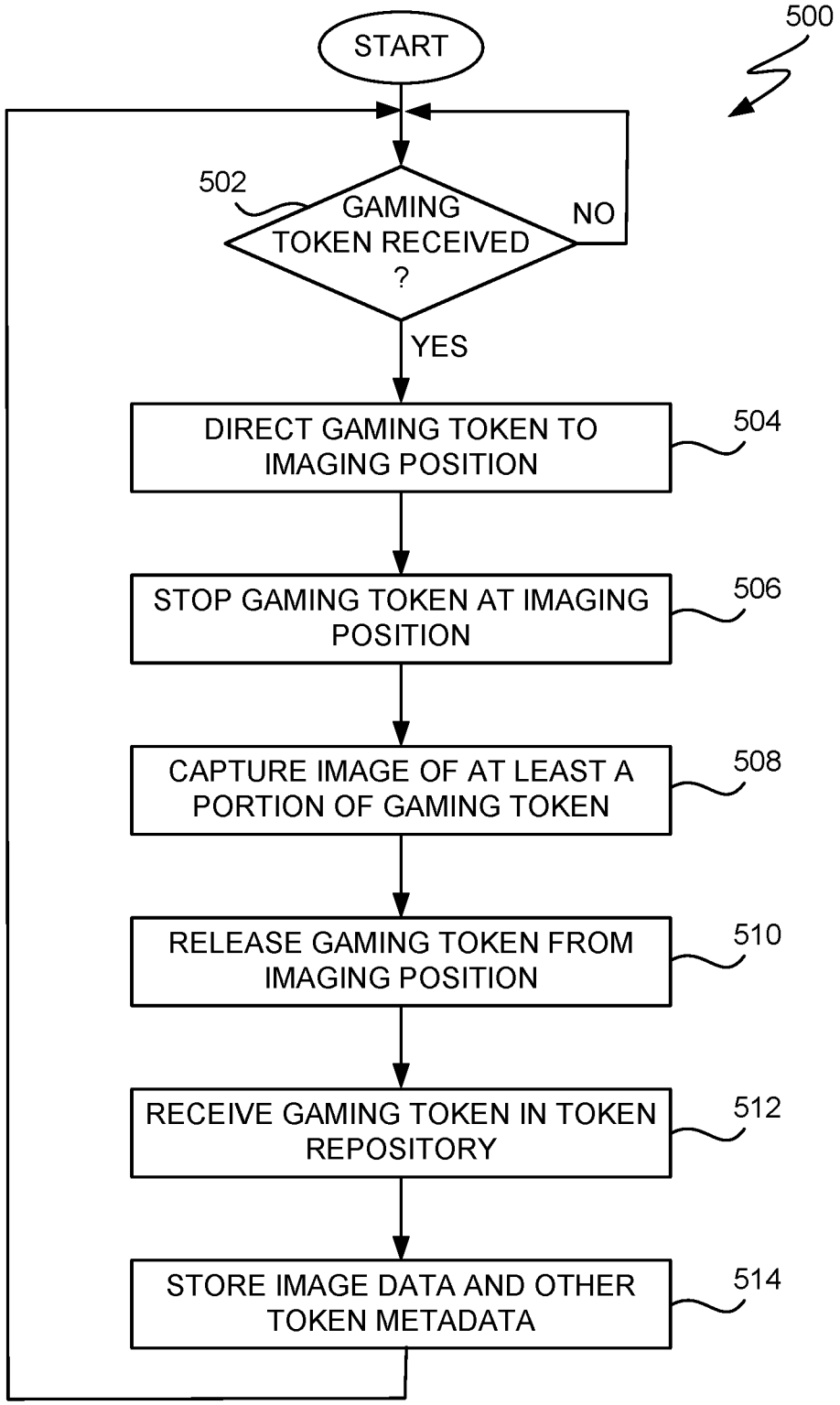
FIG. 5 is a flow diagram of a token reception process according to one embodiment.

FIG. 5 is a flow diagram of a token reception process 500 according to one embodiment. The token reception process 500 can be performed by an electronic or computing device, which for example can include a token repository apparatus, such as a token repository apparatus 116 illustrated in FIG. 1 or the token repository apparatus 200 illustrated in FIG. 2, but which may also include or interact with other electronic devices or appliances of or used with a gaming apparatus or an electronic management system.

The token reception process 500 can begin with a decision 502 that determines whether a gaming token has been received. When the decision 502 determines that a gaming token has not yet been received, the token reception process 500 can await such a token. On the other hand, once the decision 502 determines that a gaming token has been received, the gaming token can be directed 504 to an imaging position. Typically, the imaging position is a portion of a token repository apparatus that supports capturing an image associated with the game token. Hence, following the gaming token being directed to the imaging position, the gaming token is stopped 506 at the imaging position.

Next, an image of at least a portion of the gaming token can be captured 508. Here, the gaming token is presently stopped at the imaging position and the capture of the image of at least a portion of the gaming token can be performed. Additionally, as discussed in other embodiments, a light or illumination can be provided to facilitate the capture of the image. After the image of at least a portion of the gaming token has been captured 508, the gaming token can be released 510 from the imaging position. Thereafter, the gaming token is received 512 at a token repository, which provides a repository for those of the gaming tokens that have passed through the token repository apparatus.

Finally, image data acquired from the capture 508 of the image of at least a portion of the gaming token (and perhaps other token metadata) can be stored 514. Following the storage 514 of the image data and any token metadata, the token reception process can return to repeat the decision 502 and subsequent blocks so that subsequent gaming tokens can the similarly processed.

In general, the token reception process 500 operates to acquire attributes of a token that has been received at a token repository apparatus. As previously noted, an image of a token is a useful attribute. An image can provide data on color, patterns, surface characteristics, etc. of a token. Other useful attributes that can be capture through use of other sensors can include size, weight, reflectivity, etc. The data pertaining to any such attributes can be referred to as token metadata. One or more sensor can be provided in the token repository apparatus to acquire metadata. The metadata can be acquired while the gaming token is stopped at the imaging position, or can be acquired elsewhere within the token repository apparatus.

Figure 6A:
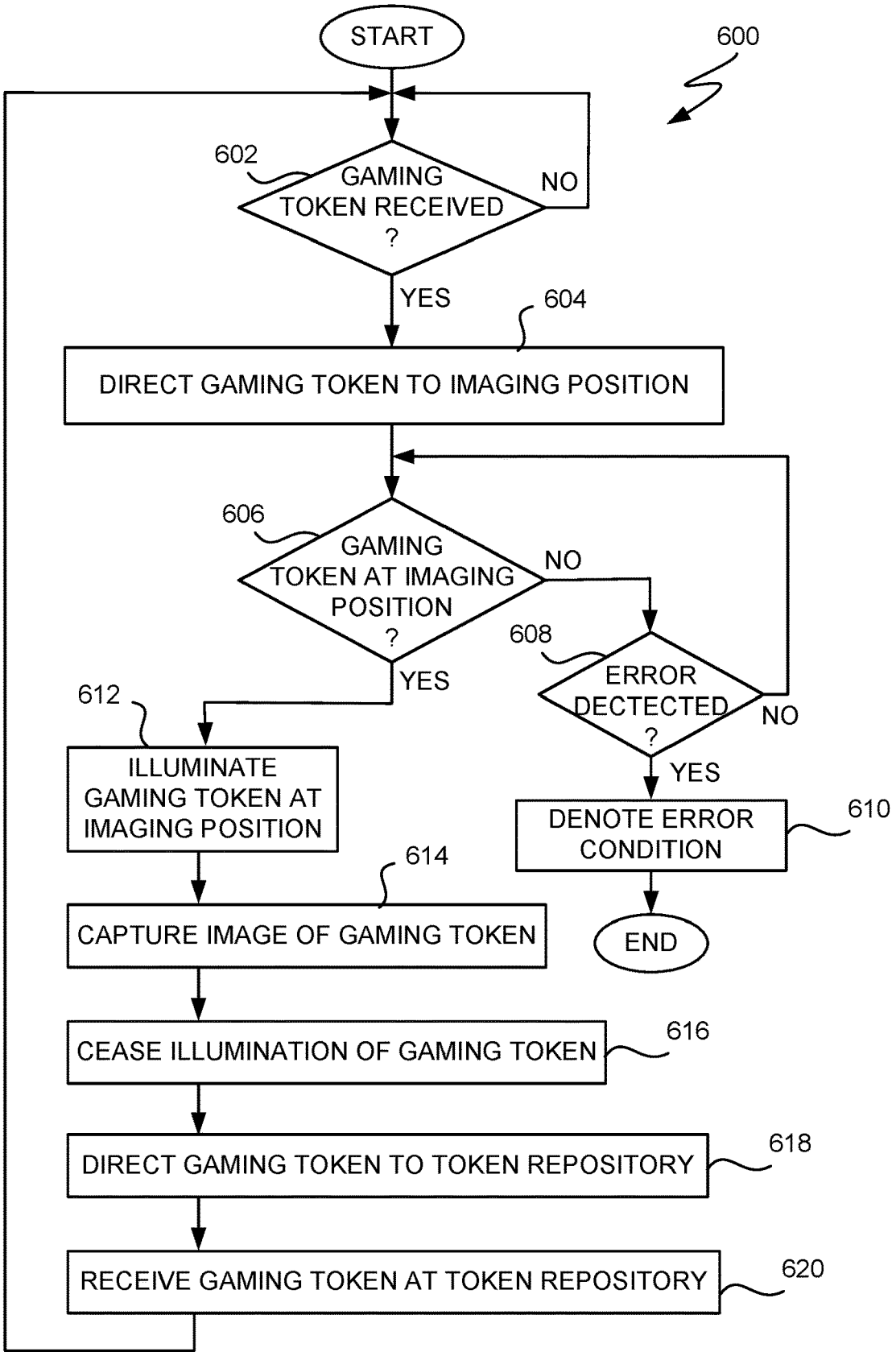
FIG. 6A is a token reception process according to another embodiment.

FIG. 6A is a token reception process 600 according to another embodiment. The token reception process 600 can be performed by an electronic or computing device, which for example can include a token repository apparatus, such as a token repository apparatus 116 illustrated in FIG. 1 or the token repository apparatus 200 illustrated in FIG. 2, but which may also include or interact with other electronic devices or appliances of or used with a gaming apparatus or an electronic management system.

The token reception process 600 can begin with a decision 602 that determines whether a gaming token has been received. When the decision 602 determines that gaming token has not yet been received, the token reception process 600 can await such a gaming token. On the other hand, once the decision 602 determines that a gaming token has been received, the gaming token can be directed 604 to an imaging position. The imaging position pertains to a position for the gaming token within the token repository apparatus where an image can be captured.

Next, a decision 606 can determine whether the gaming token is at the imaging position. When the decision 606 determines that the gaming token is not at the imaging position, a decision 608 can determine whether an error is detected. When the decision 608 determines that an error has been detected, the token reception process 600 can denote 610 an error condition and the token reception process 600 can end. Alternatively, when the decision 608 determines that an error has not been detected, the token reception process 600 can return to repeat the decision 606 to again determine whether the gaming token is at the imaging position.

After the decision 606 determines that the gaming token is at the imaging position, the gaming token at the imaging position can be illuminated 612. For example, a light source, such as a Light-Emitting-Diode (LED), can be used to illuminate the gaming token. Then, an image of the gaming token can be captured 614. Following the capture 614 of the image, the illumination of the gaming token can cease 616. Thereafter, the gaming token can be directed 618 to a token repository of the token repository apparatus. Finally, the gaming token can be received 620 at the token repository. After the gaming token has been received 620 at the token repository, the token reception process 600 can return to repeat the decision 602 and subsequent blocks so that additional gaming tokens can be similarly processed.

Figure 6B:
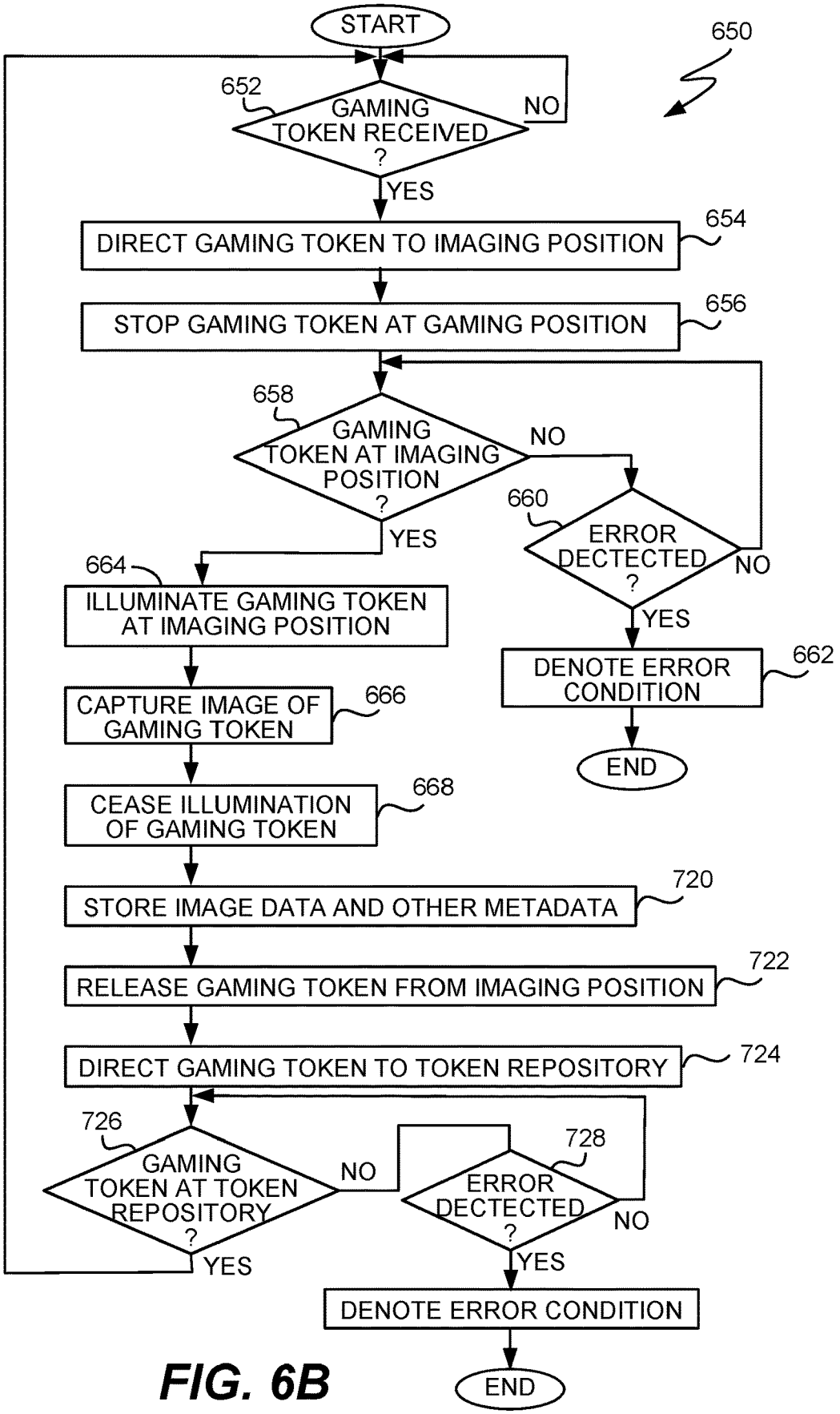
FIG. 6B is a token reception process according to still another embodiment.

FIG. 6B is a token reception process 650 according to still another embodiment. The token reception process 650 can be performed by an electronic or computing device, which for example can include a token repository apparatus, such as a token repository apparatus 116 illustrated in FIG. 1 or the token repository apparatus 200 illustrated in FIG. 2, but which may also include or interact with other electronic devices or appliances of or used with a gaming apparatus or an electronic management system.

The token reception process 650 can begin with a decision 652 that determines whether a gaming token has been received. When the decision 652 determines that gaming token has not yet been received, the token reception process 650 can await such a gaming token. On the other hand, once the decision 652 determines that a gaming token has been received, the gaming token can be directed 654 to an imaging position. The imaging position pertains to a position for the gaming token within the token repository apparatus where an image can be captured. The gaming token is stopped 656 at the imaging position.

Next, a decision 658 can determine whether the gaming token is at the imaging position. When the decision 658 determines that the gaming token is not at the imaging position, a decision 660 can determine whether an error is detected. When the decision 660 determines that an error has been detected, the token reception process 650 can denote 662 an error condition and the token reception process 650 can end. Alternatively, when the decision 660 determines that an error has not been detected, the token reception process 650 can return to repeat the decision 658 to again determine whether the gaming token is at the imaging position.

After the decision 658 determines that the gaming token is at the imaging position, the gaming token at the imaging position can be illuminated 664. For example, a light source, such as a Light-Emitting-Diode (LED), can be used to illuminate the gaming token. Then, an image of the gaming token can be captured 666. Additionally, if desired, other metadata pertaining to the gaming token can be captured.

Following the capture 666 of the image, the illumination of the gaming token can cease 668. Image data associated with the image as well as any other metadata can be stored 670. The stored data can be subsequently used for validation, accounting, and/or auditing.

Thereafter, the gaming token can be released 672 from the imaging position. Once released 672, the gaming token can be directed 674 to a token repository of the token repository apparatus. Finally, a decision 676 can determine whether the gaming token has been received at the token repository. When the decision 676 determines that that the gaming token is not at the token repository, a decision 678 can determine whether an error is detected. When the decision 678 determines that an error has been detected, the token reception process 650 can denote 680 an error condition and the token reception process 650 can end. Alternatively, when the decision 678 determines that an error has not been detected, the token reception process 650 can the decision 678 to again determine whether the gaming token is at the token repository. After the decision 676 determines that gaming token is at the token repository, the token reception process 650 can return to repeat the decision 652 and subsequent blocks so that additional gaming tokens can be similarly processed.

Additionally, image captured data, alone or in combination with other captured data (captured metadata), can be processed to validate a token. The validation processing can yield generated metadata which can denote validation indicators. Examples of generated metadata can be color match accuracy, decoded denomination, degree of uncertainty (measured tolerance), etc. The generated metadata is done after image processing (either locally or at a remote server).

Image processing can have a training mode and a recognition mode. In general, the training mode produces reference data, and the recognition mode produces processed data. Validation of a token can compare processed data for the token to the reference data. The validation processing can use any of a variety of algorithms, such as K-means, ORB, SURF, SIFT, FLANN, etc.

In one embodiment, the training mode can train for each different token. That is, for different denomination of tokens, different training is performed. In the training mode, one or more tokens of a particular denomination are deposited into a token repository apparatus so that attribute data can be acquired. The attribute data includes at least image data. The image data can be processed to yield color data and feature data.

To obtain the color data, the following processing steps can be used:

1. Mask token image such that only an outer perimeter portion of the token (which in this embodiment contains color markings) is revealed.
2. Convert to LAB color space.
3. Apply a median blur.
4. Apply K-Means clustering algorithm to LAB image data to find dominant color clusters.

5. Compute centroid in LAB color space for each color cluster.
6. Store centroid values for each cluster along with LAB color value in database for this denomination.
7. Compute mean and max deviation for all centroids associated with this denomination and store.

To obtain the feature data, the following processing steps can be used:

1. Mask token image such that only an outer perimeter portion of the token (which in this embodiment contains color markings) is revealed.
2. Convert to greyscale.
3. Extract feature keypoints using ORB (Oriented FAST and Rotated BRIEF (ORB)) and store in database for this denomination.

In one embodiment, the recognition mode operates when a token repository apparatus receives one or more tokens and attribute data is acquired. The attribute data includes at least image data. The image data can be processed to yield color data and feature data.

To obtain and compare color data, the following processing steps can be used:

1. Mask token image such that only an outer perimeter portion of the token (which in this embodiment contains color markings) is revealed.
2. Convert to LAB color space.
3. Apply a median blur.
4. Apply K-Means clustering algorithm to LAB image data to find dominant color clusters.
5. Compute centroid in LAB color space for each color cluster.
6. Then, using the reference data for each of the denominations, for each cluster, compute Delta-E value (Euclidean distance in LAB color space) between the current cluster centroids and mean values of trained cluster centroids for all denominations.
7. Determine closest match, i.e., the denomination associated with cluster set in the reference data that produces the lowest Delta-E values.
8. Generate a score for the closest match.

To obtain and compare feature data, the following processing steps can be used:

1. Mask token image such that only an outer perimeter portion of the token (which in this embodiment contains color markings) is revealed.
2. Convert to greyscale.
3. Extract feature key points using ORB (Oriented FAST and Rotated BRIEF (ORB)) and store in database for this denomination.
4. Then, using the reference data for feature key points (reference feature key points) for each of the denominations, apply FLANN based matching algorithm to match the extracted feature key points against the reference feature key points.
5. Determine closest match, i.e., the denomination associated with the key point set containing the highest percentage of key points matched.
6. Generate a score for closest match.

To evaluate whether a token is recognized and valid, the following processing steps can be used:

1. If denomination identified by color match and the denomination identified by feature match both agree, and both scores are greater than specified minimum, thresholds, then denote that the received token is recognized and valid with the determined denomination. If not, the received token can be identified as not recognized and valid.

The above image processing is only one of various processing operations that can be performed.

Figure 7:
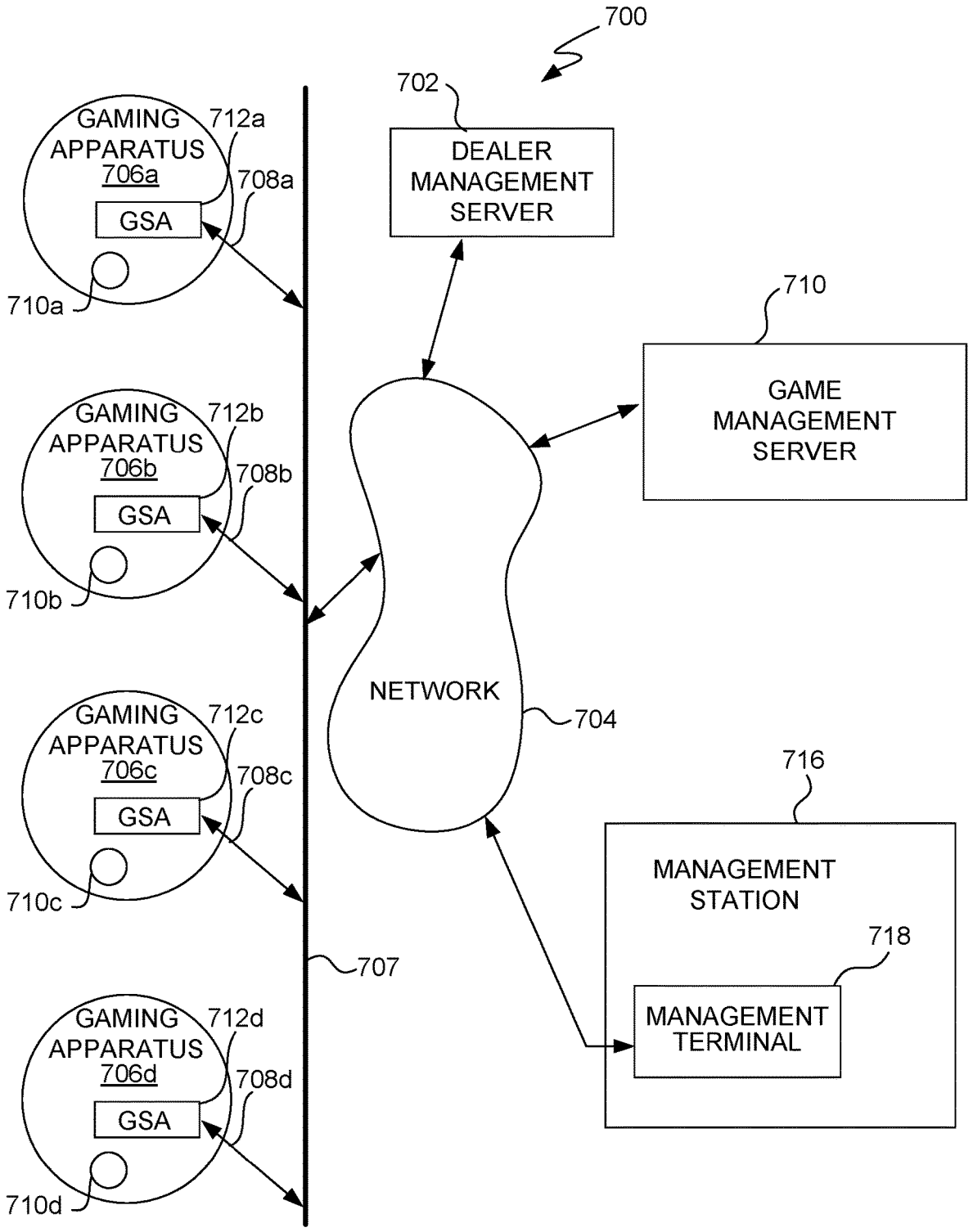
FIG. 7 is a block diagram of an electronic management system according to one embodiment.

FIG. 7 is a block diagram of an electronic management system 700 according to one embodiment. The electronic management system 700 serves to provide dealer and gaming apparatus control within a gaming environment.

The electronic management system 700 includes a dealer management server 702 that provides backend processing for the electronic management system 700. The dealer management server 702 is coupled to at least one network 704. The network 704 can be a global network, a local area network, and/or any combination of wired and/or wireless networks. The electronic management system 700 supports a plurality of gaming apparatus 706. In the embodiment illustrated in FIG. 7, the electronic management system 700 supports gaming apparatus 706*a*, gaming apparatus 706*b*, gaming apparatus 706*c*, and gaming apparatus 706*d*. The gaming apparatus 706*a*-706*d* can pertain to a game of chance, such as a wager-based game or a skill-based game, or some combination thereof. Examples of gaming apparatus include gaming tables and slot machines. The gaming apparatus 706*a* can couple to the network 704 by way of a main network link 707 and an apparatus network link 708*a*. Similarly, the gaming apparatus 706*b* can couple to the network 704 by way of the main network link 707 and an apparatus network link 708*b*; the gaming apparatus 706*c* can couple to the network 704 by way of the main network link 707 and an apparatus network link 708*c*; and the gaming apparatus 706*d* can couple to the network 704 by way of the main network link 707 and an apparatus network link 708*d*.

The gaming apparatus 706 can also include or make use of (e.g., couple to) a gaming support appliance (GSA) 712. The gaming support appliance 712 is an electronic device that is coupled or proximate to the gaming apparatus 706. In particular, the gaming apparatus 706*a*, 706*b*, 706*c* and 706*d* can respectively couple with the gaming support appliances 712*a*, 712*b*, 712*c* and 712*d*. The gaming support appliance 712 can, for example, pertain to a token repository apparatus. The token repository apparatus as the gaming support appliance 712 can be implemented in any of the various embodiments noted above.

The electronic management system 700 can further include a game management server 710. The game management server 710 can control or monitor game play at the gaming apparatus 706*a*, 706*b*, 706*c* and 706*d*. The management server 710 can interact with the gaming apparatus 706*a*, 706*b*, 706*c* and 706*d* via the network 704 for game play, game management, game regulation log, etc.

Furthermore, the electronic management system 700 can include a management station 716. The management station 716 provides information and tools to facilitate management of personnel or gaming apparatus. The management station 716 can include a management terminal 718. The management terminal 718 can be operatively connected to the network 704. The management terminal 718 can be used by personnel at the management station 716. The management terminal 718 can, for example, include or couple to a display device to present information for use by the personnel (e.g., management personnel). For example, the management terminal 718 can present information concerning a pending break or a shift change of dealers at a particular gaming apparatus. The information displayed can thus inform the management personnel that the particular gaming apparatus, or its dealer, is in need of a break or shift change. As another example, the management terminal 718 could be used to approve or decline a player's bet.

The management station 716 might also store or manage inventory for gaming supplies, and might receive and process an incoming re-supply request from a particular gaming apparatus. The information displayed can thus inform personnel that the particular gaming apparatus, or its dealer, is in need of re-supply of particular gaming supplies.

The electronic management system 700 can also be implemented together with a logistic management system, such as detailed in U.S. patent application Ser. No. 15/396,308, filed Dec. 30, 2016, and entitled "LOGISTIC MANAGEMENT OF GAMING SUPPLIES FOR GAMING ESTABLISHMENTS," which is hereby incorporated by reference. A logistics management system can provide active supply status data pertaining to the plurality of gaming apparatus 706. In this regard, the gaming apparatus 706 can make use of the gaming support appliance having the at least one electronic monitor to acquire the data pertaining to the status of supplies at the associated gaming apparatus 706. Such supply status data pertaining to the gaming apparatus 706 can be transmitted to the dealer management server 702 or a logistics management server (not shown) for storage in a transaction database or some other storage device. The supply status data can be provided to the dealer management server 702 or the logistic management server by the gaming apparatus 706 (or its gaming support appliance) in real-time or near real-time. For example, the supply status data could be provided whenever a change has been identified, on a periodic basis, or when manually or automatically triggered, or some combination thereof. A logistics management system can also interact with a supply repository to track quantities of gaming supplies resident within the supply depository. The gaming supplies can include cash, cards and chips. The quantities of the gaming supplies at the supply depository can be monitored or recorded in any of a variety of different ways, including manual counting and data entry into a management terminal, or through use of electronic sensors using an electronic appliance, or some combination thereof.

An electronic gaming system, gaming management system or fulfillment system can be implemented or embodied in various ways. Examples of several embodiments are illustrated below in FIGS. 8-10. Features of various different embodiments discussed herein can be combined as desired.

Figure 8:
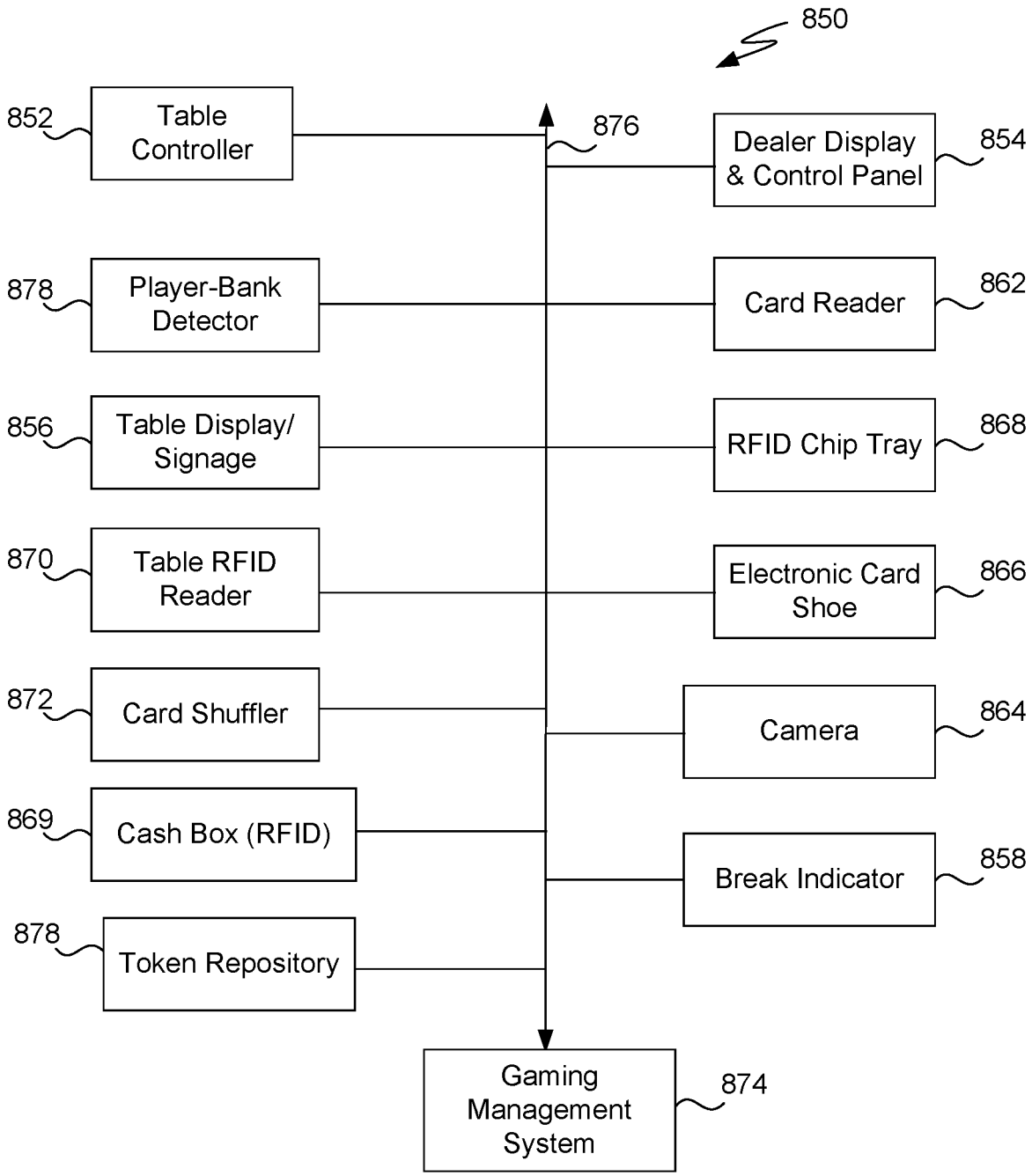
FIG. 8 illustrates a gaming apparatus according to one embodiment.

FIG. 8 illustrates a gaming apparatus 850 according to one embodiment. The gaming apparatus 850 includes various components that operate to facilitate playing of a wager-based game by one or more players. Often, the wager-based game is a card game and the gaming apparatus 850 provides a table for providing a playing surface. The gaming apparatus 850 can also include various electronic components to support playing and/or managing play of wager-based games at the gaming apparatus 850.

The gaming apparatus 850 can include a table controller 852. The table controller 852 can control overall operation of the gaming apparatus 850. For example, the table controller 852 can monitor games, cards, chips, wagers, dealers and/or players as well as receive and send data to a remote gaming management system 874 via a network. 876. The gaming apparatus includes various electronic components that can couple to the table controller 852 via the network 876. The network 876 can be wired and/or wireless, and can include one or more networks. Typically, the gaming management system 874 is associated with an establishment where the gaming apparatus 850 is present. The table controller 852 can also participate in controlling access (by dealers or others) to the gaming apparatus 850 and or its associated gaming supplies. In other words, the table controller 852 can lock and unlock the gaming apparatus. In one embodiment, the gaming apparatus 850 can provide or support the various operational states of a game of chance being provided at the gaming apparatus 850. The game of chance can be a wager-based game, a skill-based game, or some combination thereof. Examples of gaming apparatus include gaming tables, slot machines, portable gaming devices, and the like.

The gaming apparatus 850 can include a dealer display and control panel 854. The dealer display and control panel 854 can, for example, correspond to the dealer terminal 110 discussed above regarding FIG. 1 or the dealer terminal 218 discussed above regarding FIG. 2. The dealer display and control panel 854 can provide a control panel that a dealer can interact with to operate the gaming apparatus 850. In one implementation, the dealer display and control panel 854 can be a touch screen control panel. The dealer display and control panel 854 can enable the dealer to login or authenticate, deal, request or exchange gaming supplies, track chip deposits, order other services for the dealer or patrons (e.g. beverage requests), and the like.

The gaming apparatus 850 can also include a table display/signage 856. The table display/signage 856 can be implemented as a community display that can display information to interest to persons, such as players, and/or managers of dealers (e.g., pit bosses). As an example, the dealer shift change (or lockout) timer, betting timer or other information that may be of interest could be display on the table display/signage 856.

The gaming apparatus 850 can also include a break indicator 858. For example, the break indicator 858 can represent a visual indicator, such as a light (e.g., LED light), provided at the gaming apparatus 850. The break indicator 858 can clearly indicate whether or not the dealer at the gaming apparatus 850 is on a break. The break indicator 858 can be provided at the gaming apparatus 850 at one or more different positions. As one example, the break indicator 858 can be provided on an electronic card shoe. As another example, the break indicator 858 can be integral with the dealer display and control panel 854. As still another example, the break indicator 858 can be a stand-alone visual indicator, such as an LED light bar, that is controlled by the table controller 852.

The gaming apparatus 850 can also include an electronic card shoe 866 and a RFID chip tray 868. The electronic card shoe 866 can contain and release cards that are used in playing a wager-based card game at the gaming apparatus 850. In one embodiment, the electronic card shoe 866 can provide a locking function that can prevent cards from being removed (i.e., dealt), such as to control when the cards can be removed from the electronic card shoe 866. For example, the electronic card shoe 866 can be placed in a locked condition in which unauthorized users are unable to make use of cards from the electronic card shoe 866. In one embodiment, the electronic card shoe 866 can include a card reader 862. The card reader 862 is able to optically read the cards being removed (i.e., dealt) from the electronic card shoe 866. The data captured by the card reader 862 can be provided to the table controller 852 for monitoring of the distribution of cards from the electronic card shoe 866 in conjunction with playing of the wager-based card games at the gaming apparatus 850. The RFID chip tray 868 is one implementation of an electronic chip tray that can electronically monitor quantities of chips, markers, money, tokens, and the like within the electronic chip tray. The RFID chip tray 868 can also be coupled to the table controller 852. In one embodiment, the RFID chip tray 868 can be covered and/or locked to inhibit access to the items within the electronic chip tray, such as during lockdown of the gaming apparatus 850.

The gaming apparatus 850 can further include the table RFID reader 870. The table RFID reader 870 can be provided at the gaming apparatus 850, which can include a gaming table. The table RFID reader 870 can utilize short range radio signals to monitor game play and/or gaming supplies at the gaming apparatus 850. The table RFID reader 870 can include or interact with the RFID chip tray 868.

The gaming apparatus 850 can include a cash box 869 that can receive and store cash. In one embodiment, the cash box 869 can be a RFID cash box. The cash box 869 can include a lockout function to prevent utilization of the cash box 869 by unauthorized users or unauthorized times. The cash box 869 can be controlled by the table controller 852.

The gaming apparatus 850 can also include at least one camera 864. The camera 864 can be utilized record game status as well as to monitor gaming supplies, such as chips and cards, with respect to the gaming apparatus 850. The camera 864 can also be utilized to receive or archive player decisions, monitor card shuffling, monitor game play, monitor deposits into a token repository apparatus, etc.

The gaming apparatus 850 can further include a card shuffler 872. The card shuffler 872 can operate to automatically shuffle cards for use at the gaming apparatus 850. For example, in one implementation, the gaming apparatus 850 includes a gaming table in which a wager-based card game is played. The card shuffler 872 can shuffle the cards in an automated fashion. The card shuffler 872 can also be coupled to or integrated with the electronic card shoe 866.

Further still, in one embodiment, the table controller 852 can also provide interaction with one or more token repository 878 so that tokens deposited can be received and validated/confirmed. The token repository 878 can be constructed and utilized as disclosed in various embodiments of token repository apparatus described herein.

Additionally, the gaming apparatus 850 can also include one or more input components. In input component can be made available to a dealer or player. For example, a dealer can utilize an input component to login for authentication purposes. The input component can be coupled to the gaming apparatus 850 in general, or can be coupled to a particular component thereof, such as the electronic card shoe 866. The dealer can utilize the input component to login. For example, the input component can use a PIN entry, biometric reader, a magnetic card/fob reader, RFID token reader, and the like.

Figure 9:
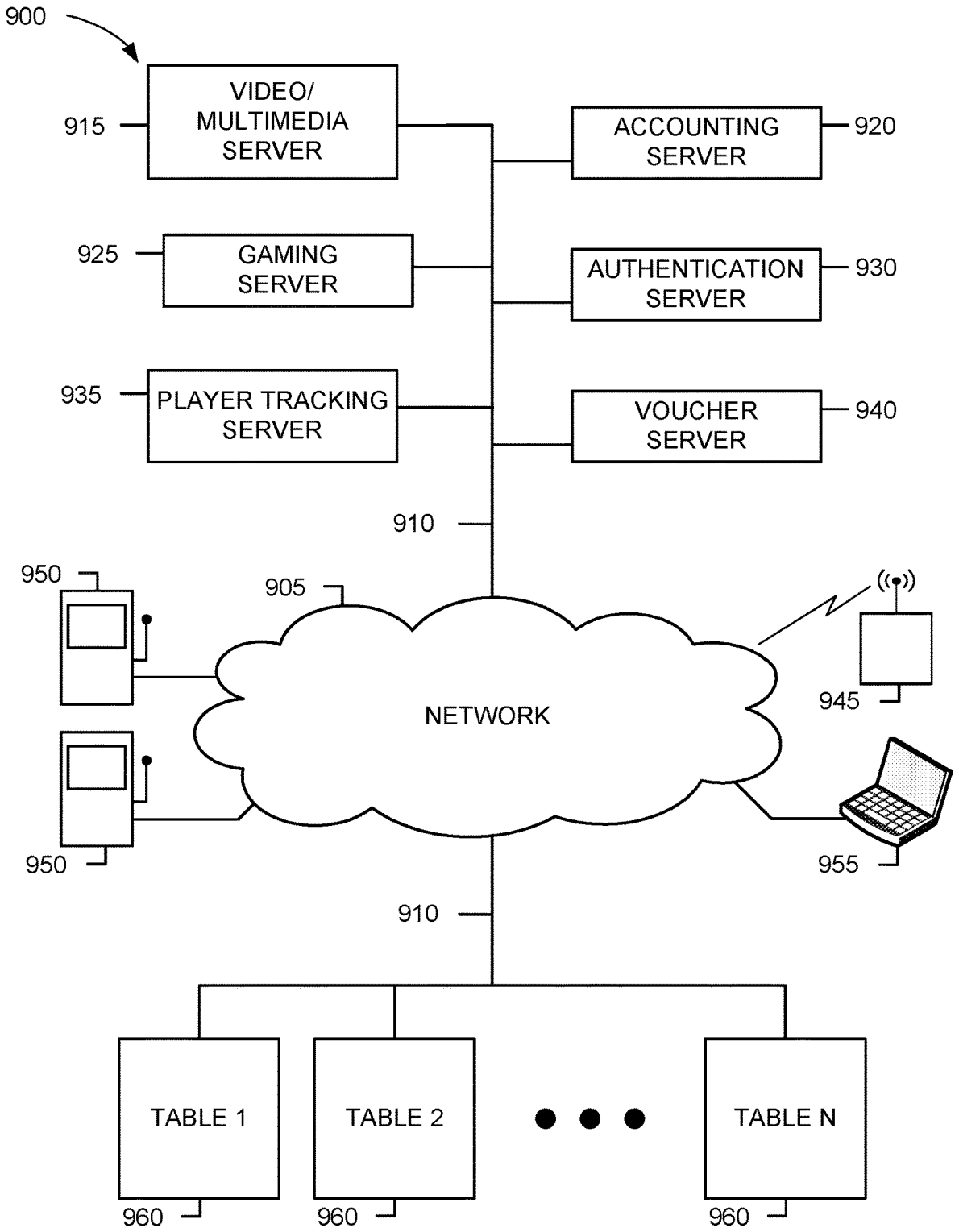
FIG. 9 illustrates an electronic gaming system according to one embodiment.

FIG. 9 illustrates an electronic gaming system 900 according to one embodiment. The electronic gaming system 900 may include electronic gaming tables 960, which may be coupled to a network 905 via a network link 910. The electronic gaming tables 960 may be gaming tables with enhanced electronic capabilities. The network 905 may be or include one or more of a public and a private network. One or more video streams may be received at a video/multimedia server 915 from the electronic gaming tables 960. The video/Multimedia server 915 may transmit one or more of these video streams to a mobile device 945, a gaming device 950, a laptop 955, and/or any other remote electronic device. The video/multimedia server 915 may transmit these video streams via the network link 910 and the network 905.

The electronic gaming system 900 may include an accounting/transaction server 920, a gaming server 925, an authentication server 930, a player tracking server 935, and a voucher server 940.

The accounting/transaction server 920 may compile, track, store, and/or monitor cash flows, voucher transactions, winning vouchers, losing vouchers, and/or other transaction data for the casino operator and for the players. Transaction data may include the number of wagers, the size of these wagers, the date and time for these wagers, the identity of the players making these wagers, and the frequency of the wagers. The accounting/transaction server 920 may generate tax information relating to these wagers. The accounting/transaction server 920 may generate profit/loss reports for predetermined gaming options, contingent gaming options, predetermined betting structures, and/or outcome categories.

The gaming server 925 may generate gaming options and/or outcomes based on predetermined betting structures and/or outcome categories. These gaming options may be predetermined gaming options, contingent gaming options, and/or any other gaming option disclosed herewith.

The authentication server 930 may determine the validity of vouchers, players' identity, and/or an outcome for a gaming event.

The player tracking server 935 may track a player's betting activity, a player's preferences (e.g., language, drinks, font, sound level, etc.), and other player actions or data. Based on data obtained by the player tracking server 935, a player may be eligible for gaming rewards (e.g., free play), promotions, and/or other awards (e.g., complimentary food, drinks, lodging, concerts, etc.).

The voucher server 940 may generate a voucher, which may include credit data or data relating to gaming options. For example, a voucher can be provided that represent a credit value and can be redeemed for game play or cash out. As another example, data relating to the structure (e.g., 6 out of the next 10 rolls at craps table 4 will be a 7 or 11) may be generated. If there is a time deadline, that information may be generated by the voucher server 940. Vouchers may be physical (e.g., paper) or digital.

Figure 10:
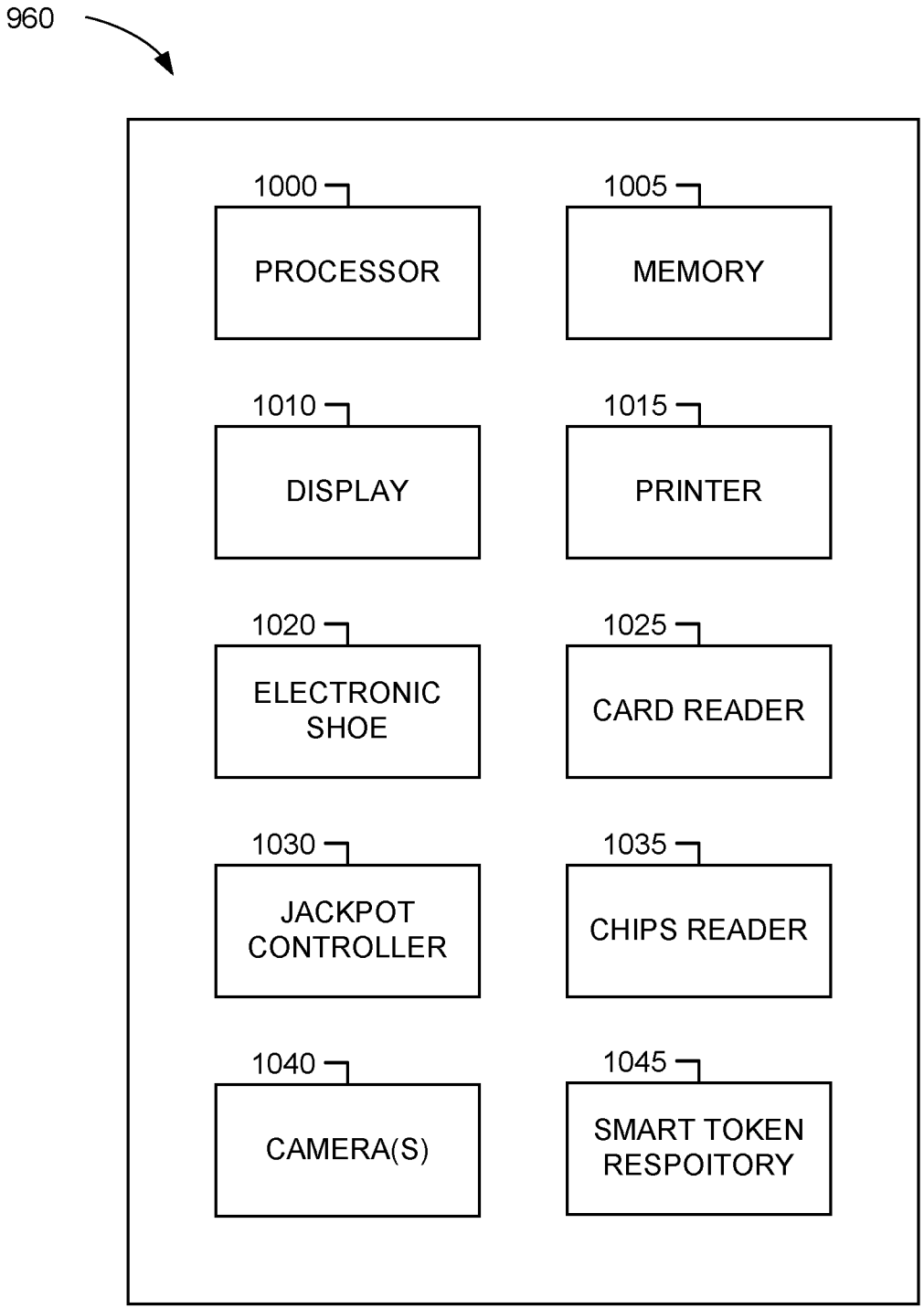
FIG. 10 shows electronic gaming table with various features, according to one embodiment.

FIG. 10 shows electronic gaming table 960 with various features, according to one embodiment. The electronic gaming table 960 can represent any of the one or more electronic gaming tables shown in FIG. 9. The electronic gaming table 960 may include a processor 1000, a memory 1005, a display 1010, a printer 1015, an electronic shoe 1020, a card reader 1025, a jackpot controller 1030, a chips reader 1035, one or more cameras 1040, and one or more smart token repository 1045.

The processor 1000 may be communicatively coupled to any other device in the electronic gaming table 960. The processor 1000 via an interface may communicate, wired or wireless, with any of the elements of the electronic gaming system 1100.

The memory 1005 may include data relating to gaming events, video streams transmitted from the electronic gaming table 960, winning and losing percentages for gaming options relating to the electronic gaming table 960, and game management data (e.g., dealer schedule, chip deposits, chip refills, etc.).

The display 1010 may show previous game results, a betting structure, outstanding bets, transaction volume, present value of betting options, a table minimum bet, a table maximum bet, game state, betting window status, or any other data.

The printer 1015 may generate vouchers, promotional items, food tickets, event tickets, chip/cash vouchers, card vouchers and/or lodging tickets. Vouchers may be physical (e.g., paper) or digital.

The electronic shoe 1020 may obtain data and/or images of gaming objects utilized with the electronic gaming table 960. This data and/or images may be transmitted to electronic gaming devices and displayed as images from table games. For example, on a blackjack table a ten of spades may be dealt to a player. This information is obtained via the electronic shoe 1020 and utilized to generate an image and/or illustration of a ten of spades card, which maybe shown as images from table games displayed at the gaming tables 960 and/or mobile devices 945, gaming devices 950, laptops 955. In another example, electronic shoe 1020 may receive data relating to numbers on dice, transmit this data to electronic gaming system, which may be utilized to generate an image/illustration of the dice by electronic gaming system (e.g., images from table games displayed at electronic gaming tables 960 and/or mobile device 945, a gaming device 950, a laptop 955.).

The card reader 1025 may provide identification, authentication, and application processing functions. The card reader 1025 may interface with smart cards, magnetic striped card, bar code reader, RFID card, and the like.

The jackpot controller 1030 may track and compile data associated with a jackpot. The jackpot controller 1030 may award the jackpot on a specific occurrence (e.g., dealing a royal flush) and/or randomly award a jackpot.

The chips reader 1035 may compile and track data associated with the amount of chips one or more players possesses, the amount of chips won/lost at the gaming table 960, the amount of chips in the dealer's rack at the gaming table 960, an amount of chips bet by one or more players, amount of chips in the betting pool, and/or any combination thereof.

The camera 1040 may obtain data from the electronic gaming table 960. The camera 1040 may be one or more cameras located to view the gaming objects (e.g., cards, dice, dominos, chips, ball, wheel, etc.), the dealer, the shoe, the players' hands, the players, wagers (bets) and/or any combination thereof. The camera 1040 may transmit this data to the electronic gaming table 960, which may be utilized to generate an image/illustration of the gaming objects.

The electronic betting assistant 1045 can be provide at the electronic gaming table 960 to assist with placement of wagers (bets). The wagers can be electronically evaluated to determine a value of a player's wager. The wager can be on a wager-based game played locally at the electronic gaming table 960 or remotely at another gaming device. The wager can pertain to a primary bet, a side bet, a back bet, or an auxiliary bet. The construction and operation of the electronic betting assistant 1045 can use any of the above described embodiments for such apparatus, where such embodiments can be used individually or in any combination.

The various aspects, features, embodiments or implementations of the invention described above can be used alone or in various combinations.

Embodiments of the invention can, for example, be implemented by software, hardware, or a combination of hardware and software. Embodiments of the invention can also be embodied as computer readable code on a computer readable medium. In one embodiment, the computer readable medium is non-transitory. The computer readable medium is any data storage device that can store data which can thereafter be read by a computer system. Examples of the computer readable medium generally include read-only memory and random-access memory. More specific examples of computer readable medium are tangible and include Flash memory, EEPROM memory, memory card, CD-ROM, DVD, hard drive, magnetic tape, and optical data storage device. The computer readable medium can also be distributed over network-coupled computer systems so that the computer readable code is stored and executed in a distributed fashion.

Numerous specific details are set forth in order to provide a thorough understanding of the present invention. However, it will become obvious to those skilled in the art that the invention may be practiced without these specific details. The description and representation herein are the common meanings used by those experienced or skilled in the art to most effectively convey the substance of their work to others skilled in the art. In other instances, well-known methods, procedures, components, and circuitry have not been described in detail to avoid unnecessarily obscuring aspects of the present invention.

In the foregoing description, reference to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A gaming token apparatus, comprising:

an input and evaluation portion configured to receive a token and to evaluate the token, the input and evaluation portion including at least a token sensor configured to acquire metadata pertaining to the token, the metadata including at least gaming establishment data; and a token repository coupled to the input and evaluation portion, the token repository receiving tokens that pass through the input and evaluation portion via a defined token path, wherein the input and evaluation portion includes a token singulator that includes at least one extended element that is configured to singulate the passage of tokens through at least a portion of the token path.

2. A gaming token apparatus as recited in claim 1, wherein the gaming token apparatus comprises:

a token entry opening configured to receive a gaming token; and a channel configured to guide the received gaming token between the token entry opening and the token repository, the channel providing at least a portion of the defined token path.

3. A gaming token apparatus as recited in claim 2, wherein the token entry opening is a slot, and wherein the channel is further configured to guide the received gaming token through the input and evaluation portion.

4. A gaming token apparatus as recited in claim 1, wherein the input and evaluation portion comprises:

a token detector positioned to detect presence of a gaming token at the input and evaluation portion;

a token stop actuator configured to controllable temporarily stop the gaming token at the input and evaluation portion;

a camera for capturing at least one image of the gaming token temporarily stopped at the input and evaluation portion; and a controller operatively connected to the token detector, the token stop actuator, and the camera, the controller determines presence of the gaming token at the input and evaluation portion based on the token detector, controls the token stop actuator to temporarily stop the gaming token at the input and evaluation portion, and controls the camera to capture of the at least one image of the gaming token temporarily stopped at the input and evaluation portion.

5. A gaming token apparatus as recited in claim 4, wherein the input and evaluation portion comprises:

a light source controlled by the controller to provide light at least during the image capture by the camera, the light being provided in the vicinity of the gaming token temporarily stopped at the input and evaluation portion.

6. A gaming token apparatus as recited in claim 4, wherein the input and evaluation portion comprises:

an additional sensor provided to capture characteristics data of the gaming token.

7. A gaming token apparatus as recited in claim 4, wherein the input and evaluation portion comprises:

a memory configured to store at least image data of the captured image; and a communication interface for communicating image data of the captured image to a remote computing device.

8. A gaming token apparatus as recited in claim 4, wherein the input and evaluation portion comprises:

a display controlled to display a visual indication pertaining to the gaming token.

9. A gaming token apparatus as recited in claim 4, wherein the controller further at least partially validates the gaming token based at least in part on the captured image of the gaming token.

10. A gaming token apparatus as recited in claim 1, wherein the input and evaluation portion is coupled to a gaming table.

11. A gaming token apparatus as recited in claim 1, wherein the token repository is removable from the gaming token apparatus.

12. A method for accepting gaming tokens, the method comprising:

receiving a gaming token into a token entry opening of a token repository apparatus, the token repository apparatus having a defined token path to an imaging portion;

directing the gaming token via a defined token path to the imaging position;

ensuring singulation of gaming tokens, including the gaming token, through at least a portion of the token path;

stopping the gaming token at the imaging position;

acquiring metadata pertaining to the gaming token;

capturing an image of at least a portion of the gaming token while the gaming token is stopped at the imaging position; and releasing the gaming token from the imaging position after the image of the at least a portion of the gaming token has been captured.

13. A method as recited in claim 12, wherein the method comprises:

determining that the gaming token, following the releasing, has been received at the token repository apparatus.

14. A method as recited in claim 12, wherein the method comprises:

validating the gaming token based on the captured image.

15. A method as recited in claim 12, wherein the method comprises:

determining a value of the gaming token based on the captured image.

16. A method as recited in claim 15, wherein the method comprises:

displaying the value on a display device proximate to the token entry opening.

17. A method as recited in claim 12, wherein the metadata acquired includes at least gaming establishment data.

18. A method as recited in claim 12, wherein the method comprises:

acquiring a time of receipt of the gaming token.

19. A method as recited in claim 12, wherein the method comprises:

acquiring weight and/or size data for the gaming token.

20. A method as recited in claim 12, wherein the gaming token apparatus is coupled to a gaming table.

21. A non-transitory computer readable medium including at least computer program code stored therein for processing gaming tokens for a token management apparatus including an evaluation portion and a repository portion, the token management apparatus having a defined token path to the evaluation portion, the computer readable medium comprising:

computer program code for controlling singulation of gaming tokens through at least a portion of the token path;

computer program code for detecting a gaming token at the evaluation portion internal to the token management apparatus;

computer program code for acquiring metadata pertaining to the gaming token, the metadata including at least gaming establishment data;

computer program code for initiating illumination of a light source at least for a period of time while the gaming token is at the evaluation portion;

computer program code for initiating capturing an image of at least a portion of the gaming token;

computer program code for ceasing the illumination of the light source after the image of the at least a portion of the gaming token has been captured; and computer program code for permitting the gaming token to be received in the repository portion.

* * * * *